US005730111A

United States Patent [19]

Kaji et al.

[11] Patent Number: 5,730,111

[45] Date of Patent: Mar. 24, 1998

[54] AIR-FUEL RATIO CONTROL SYSTEM FOR INTERNAL COMBUSTION ENGINE

[75] Inventors: Yasumasa Kaji, Toyota; Yoshiyuki Okamoto, Anjo; Hisashi Iida, Kariya, all of Japan

[73] Assignee: Nippondenso Co., Ltd., Kariya, Japan

[21] Appl. No.: 664,840

[22] Filed: Jun. 17, 1996

[30] Foreign Application Priority Data

Jun. 15, 1995 [JP] Japan ..... 7-148993

[51] Int. Cl.[6] ..... F02D 41/14

[52] U.S. Cl. ..... 123/673

[58] Field of Search ..... 123/673

[56] References Cited

U.S. PATENT DOCUMENTS

| | | | |
|---|---|---|---|
| 4,934,328 | 6/1990 | Ishii et al. | 123/673 |
| 5,090,199 | 2/1992 | Ikuta et al. | 60/276 |
| 5,243,952 | 9/1993 | Ikuta et al. | 123/682 |

FOREIGN PATENT DOCUMENTS

| | | |
|---|---|---|
| 57-10259 | 6/1982 | Japan . |
| 3-37020 | 6/1991 | Japan . |
| 3-185244 | 8/1991 | Japan . |
| 4-209940 | 7/1992 | Japan . |

*Primary Examiner*—Andrew M. Dolinar
*Attorney, Agent, or Firm*—Cushman, Darby & Cushman IP Group of Pillsbury Madison & Sutro LLP

[57] ABSTRACT

An air-fuel ratio control system for an internal combustion engine includes an air-fuel ratio sensor provided at a collecting portion of an exhaust manifold. The air-fuel ratio sensor monitors an exhaust gas and changes its output in a linear fashion relative to an air-fuel ratio represented by the exhaust gas. The air-fuel ratio sensor is arranged at a position such that, after the number of strokes, corresponding to a multiple of the number of all cylinders, from a fuel injection for each cylinder, the air-fuel ratio sensor can measure an air-fuel ratio caused by the corresponding fuel injection. The system stores a target fuel amount for each of the cylinders. The system derives a feedback correction value depending on a deviation between a fuel amount introduced into the corresponding cylinder, which is derived based on the air-fuel ratio monitored by the air-fuel ratio sensor, and the stored number-of-stroke prior target fuel amount.

20 Claims, 13 Drawing Sheets

FIG. 13A
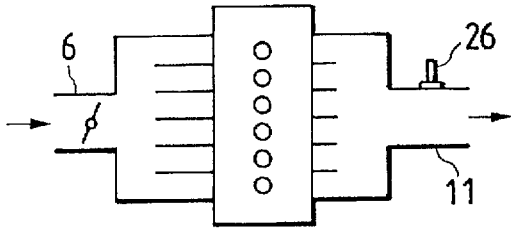
FIG. 13B
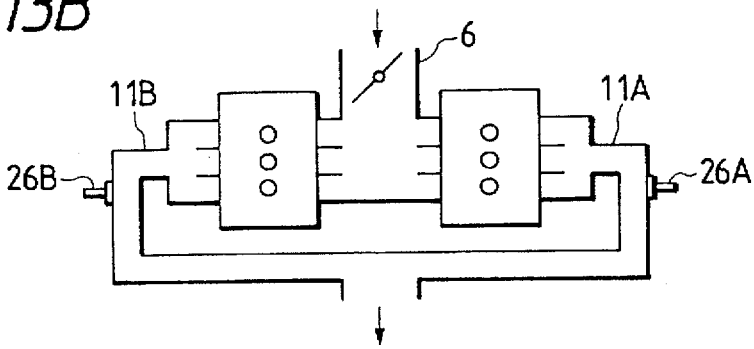
FIG. 13C
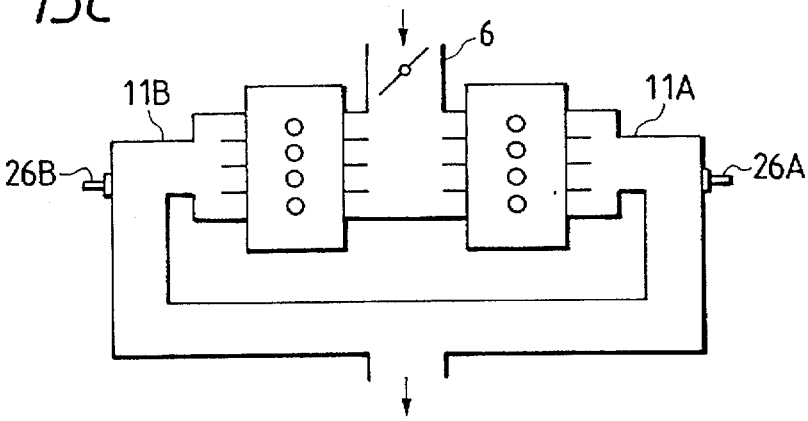
FIG. 14
| | |
|---|---|
| 4 CYLINDERS (IN-LINE) | MULTIPLE OF 4 (8, 12, 16, 20, 24 · · · ) |
| 6 CYLINDERS (IN-LINE) | MULTIPLE OF 6 (12, 18, 24, 30, · · · · ) |
| 6 CYLINDERS (V-TYPE) | MULTIPLE OF 3 (9, 12, 15, 18, 21 · · · ) |
| 8 CYLINDERS (V-TYPE) | MULTIPLE OF 4 (8, 12, 16, 20, 24 · · · ) |

AIR-FUEL RATIO CONTROL SYSTEM FOR INTERNAL COMBUSTION ENGINE

BACKGROUND OF THE INVENTION

1. Field of the Invention

The present invention relates to an air-fuel ratio control system for an internal combustion engine.

2. Description of the Prior Art

There have been proposed various air-fuel ratio control systems for improving the exhaust emission, that is, reducing harmful components, such as HC, CO and NOx, contained in the exhaust gas. One of them employs a linear-output air-fuel ratio sensor, such as a threshold-current oxygen sensor, which outputs a signal linear to the oxygen concentration (air-fuel ratio) in the exhaust gas, as disclosed in, for example, Japanese First (unexamined) Patent Publication No. 3-185244 or 4-209940. In such an air-fuel ratio control system, a feedback control is performed to minimize the deviation between an air-fuel ratio monitored by the linear-output air-fuel ratio sensor and a target air-fuel ratio so as to achieve the air-fuel ratio control with high accuracy.

However, the following problem is raised in the foregoing conventional air-fuel ratio control system. Specifically, in a case of a multi-cylinder engine, suction efficiencies are not uniform among the cylinders due to a difference in shape of an intake manifold for the respective cylinders and unevenness in operation of intake valves. Further, in a case of a multi-point injection (MPI) type, there exists unevenness among individual fuel injection valves. Accordingly, in the conventional air-fuel ratio control system, the difference in such efficiencies among the cylinders is not taken into consideration. Air-fuel ratios of air-fuel mixtures inevitably become uneven across the cylinders. This may deteriorate the exhaust emission.

SUMMARY OF THE INVENTION

Therefore, it is an object of the present invention to provide an improved air-fuel ratio control system for an internal combustion engine.

According to one aspect of the present invention, an air-fuel ratio control system for a multi-cylinder internal combustion engine, comprises an air-fuel ratio sensor arranged at a collecting portion of an exhaust manifold for monitoring an exhaust gas so as to detect an air-fuel ratio in a linear fashion; and air-fuel ratio control means for controlling the air-fuel ratio detected by the air-fuel ratio sensor so as to converge to a target air-fuel ratio. The air-fuel ratio sensor is arranged at a position so as to detect, upon the air-fuel ratio control means performing the air-fuel ratio control for one of cylinders, the air-fuel ratio corresponding to a predetermined number of times of prior fuel injection, the fuel injection having occurred for the one of the cylinders. The air-fuel ratio control means controls the air-fuel ratio for the one of the cylinders based on the air-fuel ratio detected by the air-fuel ratio sensor upon performing the air-fuel ratio control for the one of the cylinders.

It may be arranged that the air-fuel ratio control means controls the air-fuel ratio for the one of the cylinders based on the air-fuel ratio detected by the air-fuel ratio sensor upon performing the air-fuel ratio control for the one of the cylinders and further based on a predetermined number of times of prior target air-fuel ratio for the one of the cylinders, the latter predetermined number being equal to the former predetermined number.

It may be arranged that the air-fuel ratio control means includes first estimating means for estimating a fuel amount supplied to the engine based on the target air-fuel ratio and storing the estimated fuel amount per cylinder, and second estimating means for estimating a fuel amount supplied to the engine based on the air-fuel ratio detected by the air-fuel ratio sensor, and that the air-fuel ratio control means controls the air-fuel ratio for the one of the cylinders based on the fuel amount estimated by the second estimating means and a predetermined number of times of prior values of the fuel amount estimated by the first estimating means, the latter predetermined number being equal to the former predetermined number.

It may be arranged that the air-fuel ratio control means controls the air-fuel ratio for the one of the cylinders based on the air-fuel ratio detected by the air-fuel ratio sensor upon performing the air-fuel ratio control for the one of the cylinders and further based on the air-fuel ratio detected by the air-fuel ratio sensor upon performing the air-fuel ratio control for one of the cylinders which is one-cylinder prior to the one of the cylinders.

It may be arranged that the air-fuel ratio control means changes a rate of reflecting the air-fuel ratio detected by the air-fuel ratio sensor upon performing the air-fuel ratio control for the one of the cylinders and the air-fuel ratio detected by the air-fuel ratio sensor upon performing the air-fuel ratio control for one of the cylinders which is one-cylinder prior to the one of the cylinders upon the air-fuel ratio control depending on an operating condition of the engine.

According to another aspect of the present invention, an air-fuel ratio control system for a multi-cylinder internal combustion engine, comprises an air-fuel ratio sensor arranged at a collecting portion of an exhaust manifold for monitoring an exhaust gas so as to detect an air-fuel ratio in a linear fashion; basic fuel amount deriving means for deriving a basic fuel amount supplied to the engine; and air-fuel ratio control means for deriving an air-fuel ratio correction value for correcting a fuel amount so as to control the air-fuel ratio detected by the air-fuel ratio sensor to converge to a target air-fuel ratio and for correcting the basic fuel amount based on the air-fuel ratio correction value. The air-fuel ratio sensor is arranged at a position so as to detect, upon calculation of the air-fuel ratio correction value for one of cylinders, the air-fuel ratio corresponding to a predetermined number of times of prior fuel injection, the fuel injection having occurred for the one of the cylinders. The air-fuel ratio control means derives the air-fuel ratio correction value for the one of the cylinders based on the a-fuel ratio detected by the air-fuel ratio sensor upon calculation of the air-fuel ratio correction value for the one of the cylinders.

It may be arranged that the air-fuel ratio control means derives the air-fuel ratio correction value for the one of the cylinders based on the air-fuel ratio detected by the air-fuel ratio sensor upon calculation of the air-fuel ratio correction value for the one of the cylinders and further based on a predetermined number of times of prior target air-fuel ratio for the one of the cylinders, the latter predetermined number being equal to the former predetermined number.

It may be arranged that the air-fuel ratio control means includes first estimating means for estimating a fuel amount supplied to the engine based on the target air-fuel ratio and storing the estimated fuel amount per cylinder, and second estimating means for estimating a fuel amount supplied to the engine based on the air-fuel ratio detected by the air-fuel ratio sensor, and that the air-fuel ratio control means derives the air-fuel ratio correction value for the one of the cylinders based on the fuel amount estimated by the second estimating means and a predetermined number of times of prior values of the fuel amount estimated by the first estimating means, the latter predetermined number being equal to the former predetermined number.

It may be arranged that the air-fuel ratio control means derives the air-fuel ratio correction value for the one of the cylinders based on an air-fuel ratio correction value derived based on the air-fuel ratio detected by the air-fuel ratio sensor upon calculation of the air-fuel ratio correction value for the one of the cylinders and further based on an air-fuel ratio correction value for one of the cylinders which is one-cylinder prior to the one of the cylinders.

It may be arranged that the air-fuel ratio control means changes a rate of reflecting the air-fuel ratio correction value derived based on the air-fuel ratio detected by the air-fuel ratio sensor upon calculation of the air-fuel ratio correction value for the one of the cylinders and the air-fuel ratio correction value for the one-cylinder prior the one of the cylinders, upon calculation of the air-fuel ratio correction value for the one of the cylinders depending on an operating condition of the engine.

According to another aspect of the present invention, an air-fuel ratio control system for a multi-cylinder internal combustion engine, comprises an air-fuel ratio sensor arranged at a collecting portion of an exhaust manifold for monitoring an exhaust gas so as to detect an air-fuel ratio; and air-fuel ratio control means for controlling the air-fuel ratio detected by the air-fuel ratio sensor so as to converge to a target air-fuel ratio. The air-fuel ratio sensor is arranged at a position so as to detect, upon the air-fuel ratio control means performing the air-fuel ratio control for each cylinder, the air-fuel ratio corresponding to a predetermined number of times of prior fuel injection. The air-fuel ratio control means controls the air-fuel ratio for one of the cylinders based on the air-fuel ratio detected by the air-fuel ratio sensor and corresponding to the fuel injection which has occurred for the one of the cylinders.

BRIEF DESCRIPTION OF THE DRAWINGS

The present invention will be understood more fully from the detailed description given hereinbelow, taken in conjunction with the accompanying drawings.

In the drawings:

FIG. 13A is a diagram showing a schematic structure of an in-line six-cylinder internal combustion engine;

FIG. 13B is a diagram showing a schematic structure of a V-type or horizontal-opposed six-cylinder internal combustion engine;

FIG. 13C is a diagram shoving a schematic structure of a V-type or horizontal-opposed eight-cylinder internal combustion engine;

FIG. 14 is a diagram for determining the number of strokes preferable for the response of the A/F sensor with respect to each of the main multi-cylinder engines.

DESCRIPTION OF THE PREFERRED EMBODIMENT

Now, preferred embodiments of the present invention will be described hereinbelow with reference to the accompanying drawings.

Figure 1:
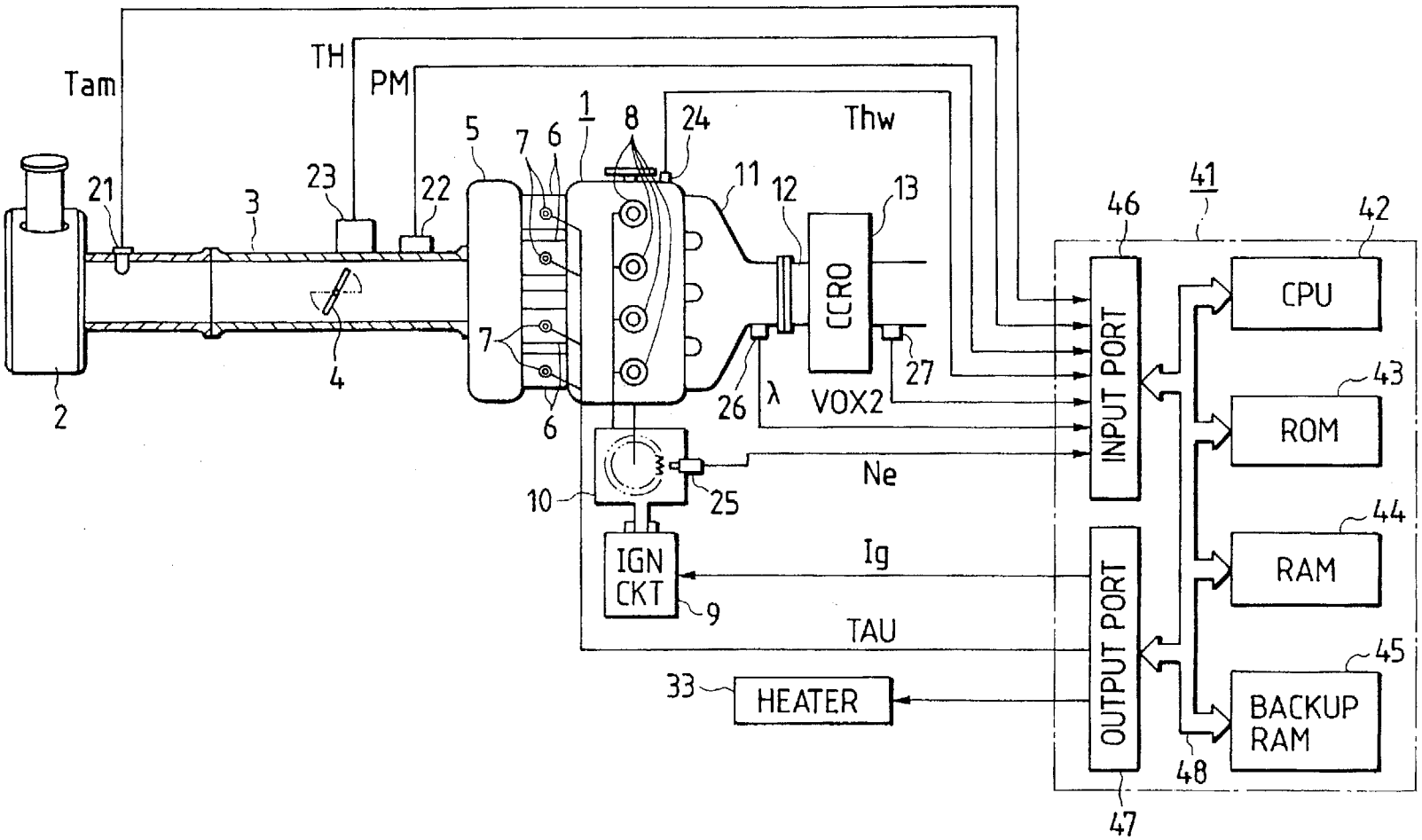
FIG. 1 is a diagram schematically showing the whole structure of an air-fuel ratio control system for an internal combustion engine according to a first preferred embodiment of the present invention.

FIG. 1 is a diagram schematically showing the whole structure of an air-fuel ratio control system for an internal combustion engine according to a first preferred embodiment of the present invention. As shown in FIG. 1, an engine 1 is of an in-line, four-cylinder, four-cycle spark ignition type. The intake air is introduced into an intake pipe 3 via an air cleaner 2 and further into an intake manifold 6 via a throttle valve 4 and a serge tank 5. In the intake manifold 6, the intake air is mixed with fuel injected from each of fuel injection valves 7 so as to form an air-fuel mixture of a given air-fuel ratio for feeding each of engine cylinders. As shown in the figure, in this embodiment, the MPI (multi-point injection) type is employed, wherein the fuel injection valve 7 is provided for each of the engine cylinders.

An ignition circuit 9 produces a high voltage, and a distributor 10 distributes the high voltage generated at the ignition circuit 9 to corresponding spark plugs 8 according to monitored angular positions of an engine crankshaft (not shown). Thus, the air-fuel mixture in each engine cylinder is ignited at a given timing. After combustion, the exhaust gas passes through an exhaust manifold 11 and an exhaust pipe 12 to reach a three-way catalytic converter 13 where the harmful components, such as CO, HC and NOx contained in the exhaust gas are purified. Then, the exhaust gas is discharged into the atmosphere.

In the intake pipe 3, an intake temperature sensor 21 and an intake manifold pressure sensor 22 are provided. The intake temperature sensor 21 monitors the temperature of the intake air (intake air temperature Tam), while the intake manifold pressure sensor 22 monitors the pressure of the intake air downstream of the throttle valve 4 (intake manifold pressure PM). Further, a throttle sensor 23 is disposed at the throttle valve 4 for monitoring the opening degree of the throttle valve 4 (throttle opening degree TH). The throttle sensor 23 outputs an analog signal depending on a throttle opening degree TH and further outputs a detection signal indicative of the throttle valve 4 being substantially fully closed. An engine coolant temperature sensor 24 is amounted on an engine cylinder block for monitoring the temperature of engine cooling water circulated in the engine 1 (cooling water temperature Thw). A speed sensor 25 is further provided at the distributor 10 for monitoring the speed of the engine 1 (engine speed Ne). The speed sensor 25 produces 24 pulses at regular angular intervals per two rotations of the engine 1, that is, per 720° CA (crank angle).

Further, in the exhaust manifold 11 upstream of the catalytic converter 13, an A/F sensor 26 (linear-output air-fuel ratio sensor) in the form of a threshold-current oxygen sensor is disposed. The A/F sensor 26 outputs, over a wide range, a linear air-fuel ratio signal which is proportional to the oxygen concentration in the exhaust gas discharged from the engine 1. Further, in the exhaust pipe 12 downstream of the catalytic converter 13, a downstream $O_2$ sensor 27 is prodded for monitoring the oxygen concentration downstream of the catalytic converter 13 so as to output a voltage VOX2 which changes depending on whether the monitored air-fuel ratio (oxygen concentration) is rich or lean with respect to a stoichiometric air-fuel ratio ($\lambda$=1). In this embodiment, the stoichiometric air-fuel ratio is set to be 14.5.

Figure 2:
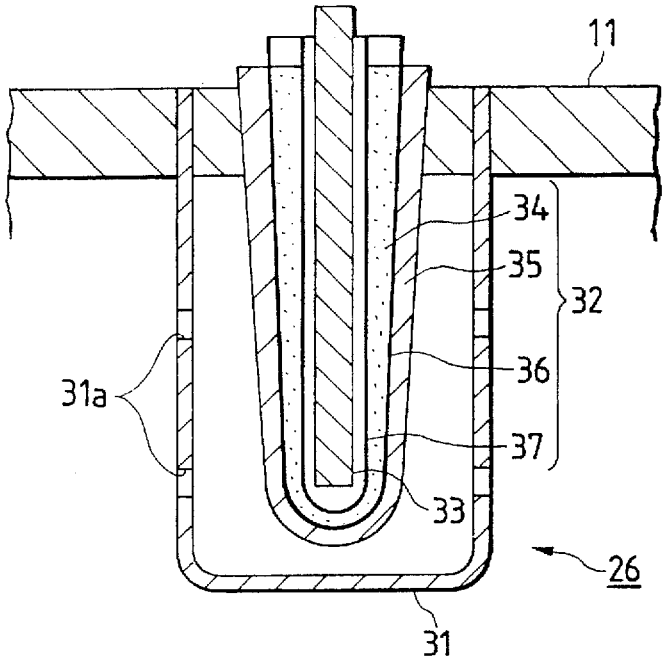
FIG. 2 is a sectional view showing a structure of an A/F sensor employed in the air-fuel ratio control system shown in FIG. 1.

FIG. 2 is a sectional view showing a structure of the A/F sensor 26. In FIG. 2, the A/F sensor 26 is amounted so as to be projected into the exhaust manifold 11. The A/F sensor 26 includes a cover 31, a sensor body 32 and a heater 33. The cover 31 has a U-shape in cross section and is formed with a number of small holes 31*a* each allowing communication between the inside and outside of the cover 31. The sensor body 32 produces the threshold current corresponding to the oxygen concentration in the air-fuel ratio lean region or corresponding to the carbon monoxide (CO) concentration in the air-fuel ratio rich region.

Now, the structure of the sensor body 32 will be described in detail. In the sensor body 32, an exhaust gas side electrode layer 36 is fixed on an outer periphery of a solid electrolyte layer 34 having a narrow U-shape, while an atmosphere side electrode layer 37 is fixed on an inner periphery thereof. Further, a diffused resistor layer 35 is formed on an outer side of the exhaust gas side electrode layer 36 by means of, for example, the plasma spraying. The solid electrolyte layer 34 is in the form of an oxygen ion conductive oxide sintered body obtained by solution-treating CaO, MgO, $Y_2O_3$, $Yb_2O_3$ or the like, as a stabilizer, relative to $ZrO_2$, $HfO_2$, $ThO_2$, $Bi_2O_3$ or the like. The diffused resistor layer 35 is made of a heat-resistant inorganic substance, such as, alumina, magnesia, quartzite, spinel, mullite or the like. The exhaust gas side electrode layer 36 and the atmosphere side electrode layer 37 are both made of noble metal having high catalytic activity, such as platinum, which are porous and formed on both outer and inner peripheries of the solid electrolyte layer 34. An area and a thickness of the exhaust gas side electrode layer 36 are set to be about 10 to 100 $mm^2$ and about 0.5 to 2.0 μm, respectively, while those of the atmosphere side electrode layer 37 are set to be no less than 10 $mm^2$ and about 0.5 to 2.0 μm, respectively.

The heater 33 is received in a space defined by the atmosphere side electrode layer 37 for heating the sensor body 32 (the atmosphere side electrode layer 37, the solid electrolyte layer 34, the exhaust gas side electrode layer 36 and the diffused resistor layer 35) due to its exothermic energy. The heater 33 has an exothermic capacity large enough to activate the sensor body 32.

In the A/F sensor 26 thus structured, the sensor body 32 produces a concentration electromotive force at the stoichiometric air-fuel ratio and a threshold current depending on the oxygen concentration in the lean region with respect to the stoichiometric air-fuel ratio. The threshold current, which corresponds to the oxygen concentration, is determined by an area of the exhaust gas side electrode layer 36 and a thickness, a porosity and a mean pore size of the diffused resistor layer 35. While the sensor body 32 can detect the oxygen concentration in a linear characteristic, the high temperature of about no less than 650° C. is required to activate the sensor body 32, and further, the activating temperature range of the sensor body 32 is narrow. Thus, the activation of the sensor body 32 cannot be controlled only by the heat from the exhaust gas of the engine 1. Accordingly, in this embodiment, the heater 33 is controlled by a later-described ECU (electronic control unit) 41 so as to hold the sensor body 32 at a predetermined temperature. In the rich region with respect to the stoichiometric air-fuel ratio, the concentration of carbon monoxide (CO), being unburned gas, changes substantially in a linear fashion relative to the air-fuel ratio, and the sensor body 32 produces the threshold current depending on the CO concentration.

Figure 3:
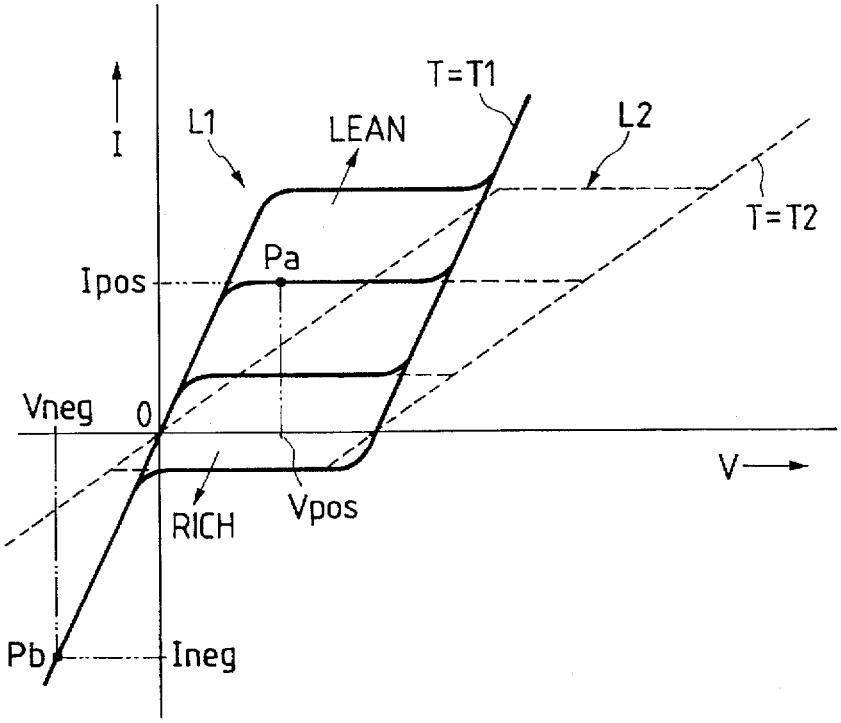
FIG. 3 is a diagram showing a voltage-current characteristic of the A/F sensor shown in FIG. 2.

FIG. 3 shows a voltage-current characteristic of the sensor body 32. As shown in FIG. 3, the voltage-current characteristic reveals a linear relationship between the current flowing in the solid electrolyte layer 34 of the sensor body 32 and being proportional to the monitored oxygen concentration (air-fuel ratio) and the voltage applied to the solid electrolyte layer 34. In the figure, when the sensor body 32 is activated at temperature T=T1, a solid characteristic line L1 represents a stable state thereof. In this case, each of straight line portions of the characteristic line L1 parallel to the voltage axis V identifies the threshold current of the sensor body 32. Change in magnitude of the threshold current corresponds to change in monitored air-fuel ratio so that the threshold current increases as the air-fuel ratio changes toward the lean side, and decreases as the air-fuel ratio changes toward the rich side.

In the voltage-current characteristic of the sensor body 32, a voltage area smaller than each straight line portion parallel to the voltage axis V is determined by the resistance so that an inclination of the characteristic line L1 in that area is determined by an internal resistance of the solid electrolyte layer 34 of the sensor body 32. Since the internal resistance of the solid electrolyte layer 34 changes depending on change in temperature, the foregoing inclination becomes smaller due to increment of the resistance when the temperature of the sensor body 32 lowers. Specifically, when the temperature T of the sensor body 32 is T2 which is lower than T1, the voltage-current characteristic is represented by a broken characteristic line L2 in FIG. 3. In this case, each of straight line portions of the characteristic line L2 parallel to the voltage axis V represents the threshold current of the sensor body 32, which is substantially equal to the threshold current identified by the characteristic line L1.

In the characteristic line L1, when a positive voltage Vpos is applied to the solid electrolyte layer 34, a threshold current Ipos flows in the sensor body 32 (see point Pa in FIG. 3). On the other hand, when a negative voltage Vneg is applied to the solid electrolyte layer 34, the current which flows in the sensor body 32 does not depend on the oxygen concentration, but becomes a negative temperature current Ineg which is proportional only to the temperature (see point Pb in FIG. 3).

Referring back to FIG. 1, the ECU 41 controls the operation of the engine 1 and includes a CPU (central processing unit) 42, a ROM (read only memory) 43, a RAM (random access memory) 44 and a backup RAM 45 which form a logical operation circuit connected to an input port 46 and an output port 47 via a bus 48. The input port 46 receives detection signals from the foregoing sensors, while the output port 47 outputs control signals to various actuators. Specifically, the ECU 41 receives, via the input port 46, the signals from the sensors indicative of the intake air temperature Tam, the intake manifold pressure PM, the throttle opening degree TH, the cooling water temperature Thw, the engine speed Ne, the air fuel ratio and the like, derives control signals, such as a fuel injection time TAU and an ignition timing Ig, based on those monitored values, and further outputs those control signals to the fuel injection valves 7, the ignition circuit 9 and the like via the output port 47.

Figure 4:
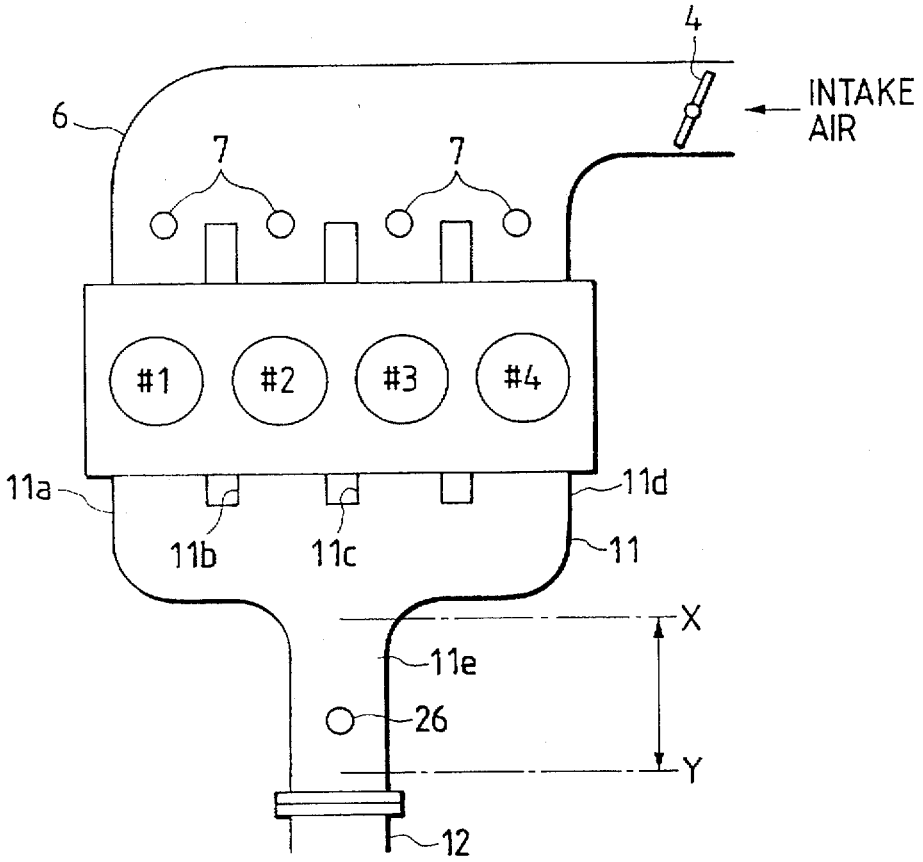
FIG. 4 is a structural diagram schematically showing induction and exhaust systems of the engine.

FIG. 4 is a structural diagram schematically showing the induction system and the exhaust system of the engine 1. In FIG. 4, the fuel injection valves 7 are arranged in the intake manifold 6 for the respective cylinders #1, #2, #3 and #4. The fuel injection valves 7 are arranged to inject the fuel for the cylinders in order of #1→#3→#4→#2→#1.

The exhaust manifold 11 includes branch portions 11*a* to 11*d* communicating with the cylinders #1 to #4, respectively, and a collecting portion 11*e* where the branch portions join. The A/F sensor 26 is disposed at a predetermined position in the collecting portion 11*e*. The disposing position of the A/F sensor 26 is determined such that distances from exhaust ports of the respective cylinders to the A/F sensor 26 are substantially equal to each other, and the exhaust gases from the respective cylinders always hit the A/F sensor 26 uniformly.

Specifically, the sensor disposing position is determined within a range of the collecting portion 11*e* between a position X and a position Y. The position X, which defines the most upstream disposing position of the A/F sensor 26, is arbitrary as long as it is downstream of the root of the collecting portion 11*e*. The position Y, which defines the most downstream disposing position of the A/F sensor 26, is also arbitrary as long as the heat from the exhaust gas can be achieved for the sensor activation. In this embodiment, the A/F sensor 26 measures the oxygen concentration (air-fuel ratio) in the exhaust gas from the cylinders #1 to #4 per cylinder, that is, for each of the cylinders #1 to #4. Accordingly, it is preferable to arrange the A/F sensor 26 at a position where the exhaust gases from the respective cylinders are not mixed with each other, and thus within about one meter from the upstream end of the exhaust manifold 11.

Further, the disposing position of the A/F sensor 26 is determined such that, after the number of strokes, corresponding to a multiple of the number of all cylinders, from a fuel injection for each cylinder, the A/F sensor 26 can measure an air-fuel ratio caused by the corresponding fuel injection. Specifically, in this embodiment employing the four-cylinder engine, numeral "8", "12", "16", "20" or the like corresponds to the foregoing number of strokes. As appreciated, as the sensor disposing position approaches the exhaust ports of the engine, the foregoing number of strokes becomes smaller.

Figure 5:
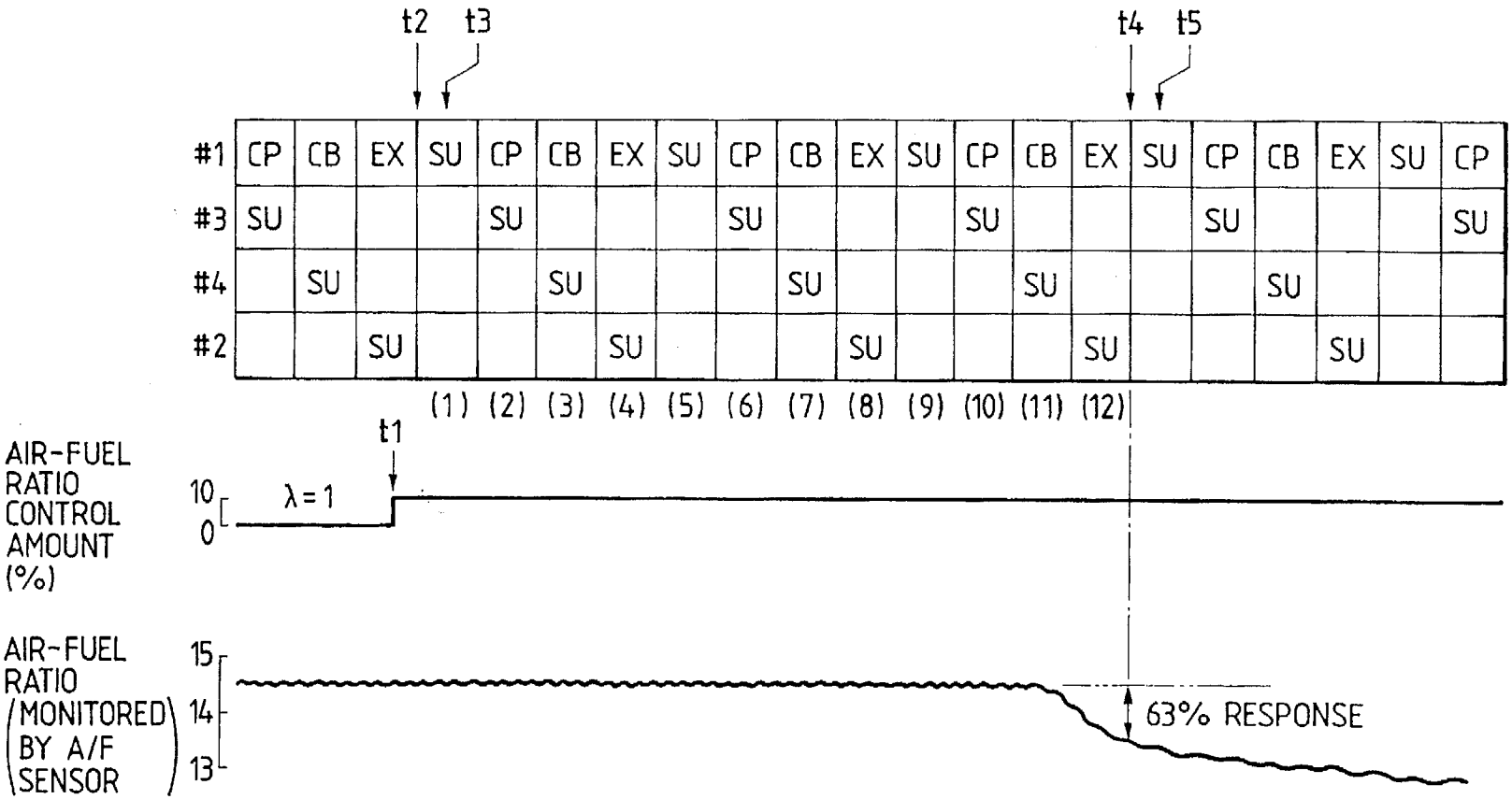
FIG. 5 is a time chart for explaining the response of the A/F sensor.
Figure 6:
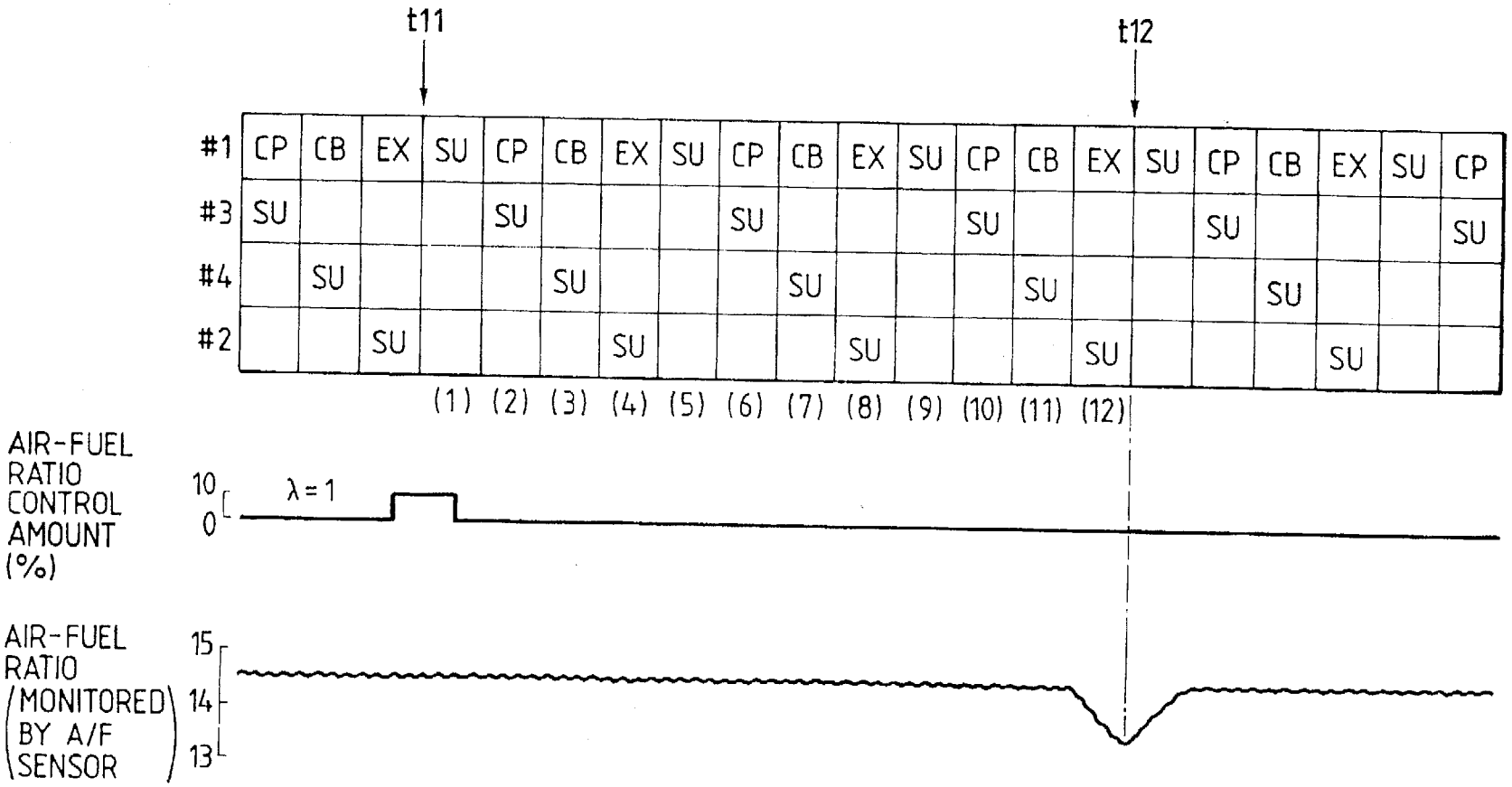
FIG. 6 is a time chart for explaining the response of the A/F sensor.

FIGS. 5 and 6 show time charts, respectively, for explaining the response of the A/F sensor 26. In each of FIGS. 5 and 6, an upper part shows the four strokes of the engine per cylinder (wherein CP represents a compression stroke, CB a combustion stroke, EX an exhaust stroke, SU a suction stroke), a middle part shows an increment/decrement state of an air-fuel ratio control amount, and a lower part shows the air-fuel ratio measured by the A/F sensor 26. Each time chart is obtained by experimentally examining the response of the A/F sensor 26 in the middle load steady state (for example, Ne=2,000 rpm).

In FIG. 5, at time t1, a command is produced to increase the air-fuel ratio control amount (enriching the air-fuel mixture) by 10% from the stoichiometric air-fuel ratio ($\lambda$=1). Then, at a calculating timing (time t2) of a fuel injection amount for the cylinder #1 immediately after t1, the fuel injection amount is set depending on the foregoing fuel increment. Thereafter, at a predetermined fuel injection timing (time t3) during a suction stroke of the cylinder #1, the fuel injection is performed relative to the cylinder #1. Then, the increased fuel is also injected for the subsequent cylinders #3, #4, #2, . . . during the suction strokes thereof, and exhausted via compression and combustion strokes in each cylinder.

Subsequently, at time t4, the initial response (63%) of the A/F sensor 26 corresponding to the foregoing fuel increment is obtained. Time t4 substantially coincides with a timing which is after a lapse of 12 strokes from the first fuel injection (the fuel injection for the cylinder #1 at time t3) after the fuel increment. This means that an air-fuel ratio corresponding to that fuel injection is measured by the A/F sensor 26 after a lapse of 12 strokes from that fuel injection. Further, at time t4, an air-fuel correction value for the cylinder #1 is calculated based on the measurement result of the air-fuel ratio, and a fuel injection amount is calculated using this correction value and injected for the cylinder #1 at time t5.

In FIG. 6, at a fuel injection amount calculating timing (t1 1) for the cylinder #1, a fuel injection amount with 10% increment (enriching) from the stoichiometric air-fuel ratio ($\lambda$=1) is derived. Immediately after this, the increased fuel is injected for the cylinder #1 during the suction stroke thereof. In FIG. 6, the fuel increment is not performed relative to the subsequent cylinders #3, #4, #2, . . . Then, at time t12 after a lapse of 12 strokes from the fuel increment, the air-fuel ratio enrichment due to the fuel increment is measured by the A/F sensor 26.

As appreciated from the foregoing, in the shown time charts, the change in air-fuel ratio is measured by the A/F sensor 26 after a lapse of 12 strokes from the corresponding fuel injection. Since numeral "12" is a multiple of the number of cylinders of the engine 1, the cylinder which discharged the measured exhaust gas 12-stroke before, matches the cylinder to be controlled, that is, to be injected with the fuel at the current time point (after a lapse of 12 strokes from the fuel injection).

Figure 7:
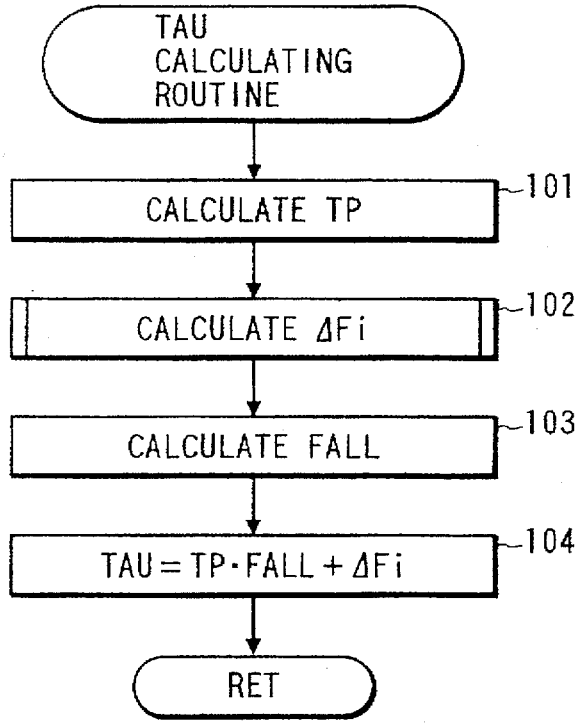
FIG. 7 is a flowchart showing a fuel injection amount calculating routine according to the first preferred embodiment.
Figure 8:
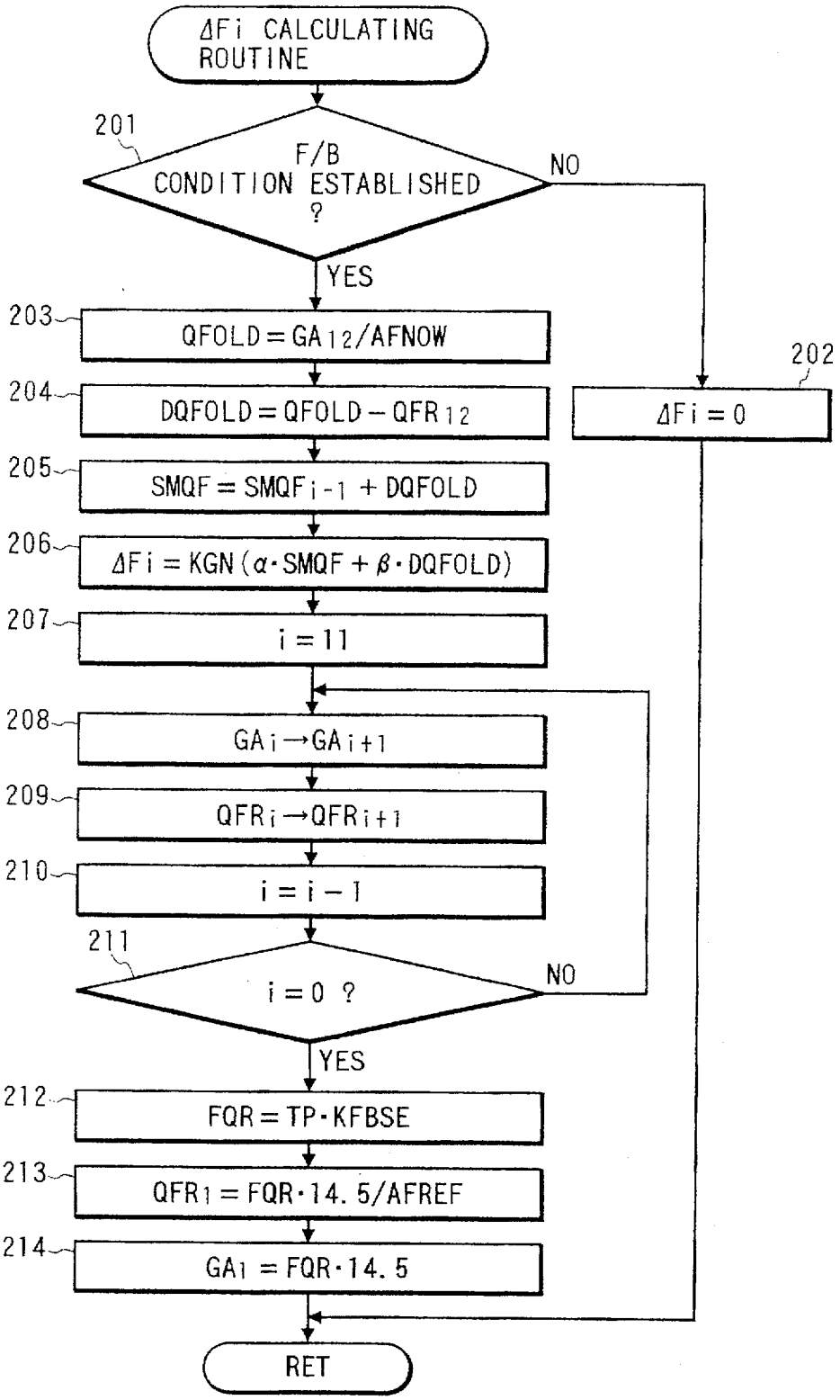
FIG. 8 is a flowchart showing a feedback correction value calculating routine according to the first preferred embodiment.

FIGS. 7 and 8 are flowcharts showing a calculation program to be executed by the CPU 42 for performing an air-fuel ratio feedback control according to the first preferred embodiment.

The flowchart of FIG. 7 shows a fuel injection amount calculating routine which is executed by the CPU 42 per fuel injection, that is, per 180° CA.

In FIG. 7, at first step 101, the CPU 42 uses an injection time map (not shown) so as to derive a basic fuel injection time TP[ms] based on the monitored intake manifold pressure PM, engine speed Ne and the like. The injection time map includes map values which are set for achieving the stoichiometric air-fuel ratio (=14.5). At subsequent step 102, the CPU 42 derives a feedback correction value $\Delta$Fi [ms] for achieving the air-fuel ratio feedback control. The feedback confection value $\Delta$Fi is a correction time derived according to a routine shown in FIG. 8, which will be described later in detail.

Thereafter, at step 103, the CPU 42 derives a known correction coefficient FALL from a water temperature based correction, an air conditioner based correction and others. Subsequently, at step 104, the CPU 42 multiplies TP by FALL and adds ΔFi to the product of TP and FALL, so as to derive a fuel injection time TAU [ms] (TAU=TP·FALL+ΔFi). Then, an operation signal corresponding to the derived fuel injection time TAU is outputted to the corresponding fuel injection valve 7.

The flowchart of FIG. 8 shows a routine for calculating the feedback correction value ΔFi, which corresponds to the process at step 102.

Before explaining the ΔFi calculating routine of FIG. 8, various calculation parameters to be used in the routine will be explained first. In the control system according to this embodiment, upon measurement of the air-fuel ratio by the A/F sensor 26, the cylinder which discharged the monitored exhaust gas is identified so as to reflect the result of the measurement by the A/F sensor 26 directly on the fuel injection for the identified cylinder. Upon fuel injection for each cylinder, a fuel injection amount FQR [mg], a target fuel amount QFR and an intake air amount GA [mg] are derived from the following equations (1) to (3):

$$FQR[mg]=TP\cdot KFBSE \quad (1)$$

$$QFR[mg]=FQR\cdot 14.5/AFREF \quad (2)$$

$$GA[mg]=FQR\cdot 14.5 \quad (3)$$

In the equation (1), the basic fuel injection time TP [ms] derived based on the engine operating conditions is converted to the fuel injection amount FQR as a mass value using a conversion factor KFBSE. In the equation (2), the fuel injection amount FQR derived by the equation (1) is multiplied by "stoichiometric air-fuel ratio (=14.5)/target air-fuel ratio AFREF" so as to derive the target fuel amount QFR. Further, in the equation (3), the fuel injection amount FQR is multiplied by the stoichiometric air-fuel ratio (=14.5) so as to derive the intake air amount GA.

The target fuel amount QFR and the intake air amount GA thus derived are stored in the RAM 44 as RAM data. Using the RAM data, a fuel amount [mg] which was actually introduced into the cylinder 12-stroke before (hereinafter referred to as "in-cylinder fuel amount QFOLD") is derived using an equation (4) noted below. Further, a deviation [mg] between the in-cylinder fuel amount QFOLD and the target fuel amount QFR (hereinafter referred to as "in-cylinder fuel deviation DQFOLD") is derived using an equation (5) noted below.

$$QFOLD[mg]=GA_{12}/AFNOW \quad (4)$$

$$DQFOLD[mg]=Q\ FOLD-QFR_{12} \quad (5)$$

wherein a subscript "12" of GA and QFR represents 12-stroke prior data from the current time, and AFNOW represents an air-fuel ratio measured by the A/F sensor 26 at the current time.

Further, an integrated value [mg] of DQFOLD derived by the equation (5) (hereinafter referred to as "deviation integrated value SMQF") is derived from the following equation (6):

$$SMQF[mg]=SMQF_{i-1}+DQFOLD \quad (6)$$

Further, using the in-cylinder fuel deviation DQFOLD derived by the equation (5) and the deviation integrated value SMQF derived by the equation (6), the feedback correction value ΔFi [ms] is derived from the following equation (7):

$$\Delta Fi[ms]=KGN\ (\alpha\cdot SMQF+\beta\cdot DQFOLD) \quad (7)$$

wherein KGN is a correction coefficient depending on a load, α is an integral term reflecting coefficient, and β is a proportional term reflecting coefficient.

Now, the ΔFi calculating routine of FIG. 8, which is prepared using the foregoing fundamental logic, will be described hereinbelow.

In FIG. 8, at first step 201, the CPU 42 determines whether the feedback condition for the air-fuel ratio control is established. As is well known, the feedback condition is determined to be established when the cooling water temperature Thw is no less than a predetermined value and when the engine is not at the high speed or under the high load. If the feedback condition is not established, the routine proceeds to step 202 where the feedback correction value ΔFi is set to "0", and then is terminated.

On the other hand, if the feedback condition is established at step 201, the routine proceeds to step 203 where the CPU 42 uses the foregoing equation (4) to derive the in-cylinder fuel amount QFOLD from the 12-stroke prior intake air amount $GA_{12}$ and the air-fuel ratio AFNOW (the result of the measurement by the A/F sensor 26 at the current time).

Subsequently, at step 204, the CPU 42 uses the foregoing equation (5) to derive the in-cylinder fuel deviation DQFOLD from the in-cylinder fuel amount QFOLD derived at step 203 and the 12-stroke prior target fuel amount $QFR_{12}$. Then, at step 205, the CPU 42 uses the foregoing equation (6) to derive the deviation integrated value SMQF from the last deviation integrated value $SMQF_{i-1}$ and the in-cylinder fuel deviation DQFOLD derived at step 204.

Thereafter, at step 206, the CPU 42 uses the foregoing equation (7) to derive the feedback correction value ΔFi from the deviation integrated value SMQF derived at step 205 and the in-cylinder fuel deviation DQFOLD derived at step 204.

Then, through steps 207 to 211, the CPU 42 performs a storing process for the RAM data for the next execution of this ΔFi calculating routine. Specifically, at step 207, "i" is set to "11" (i=11). Subsequently, at step 208, the RAM data "$GA_i$" is set to "$GA_{i+1}$" ($GA_i \rightarrow GA_{i+1}$), and at step 209, the RAM data "$QFR_i$" is set to "$QFR_{i+1}$" ($QFR_i \rightarrow QFR_{i+1}$).

Subsequently, at step 210, "i" is decremented by "1" (i=i−1), and at step 211, it is checked whether i=0. If i≠0, the routine returns to step 208 and the CPU 42 executes steps 208 to 211. Specifically, until i=0 is established at step 211, steps 208 to 211 are repeatedly executed. Through the execution of these steps, the RAM data "$GA_1$ to $GA_{11}$" are stored as "$GA_2$ to $GA_{12}$" and the RAM data "$QFR_1$ to $QFR_{11}$" are stored as "$QFR_2$ to $QFR_{12}$".

If answer at step 211 becomes positive, the routine proceeds to step 212 where the CPU 42 uses the foregoing equation (1) to derive the fuel injection amount FQR. Subsequently, at step 213, the CPU 42 uses the foregoing equation (2) to derive the target fuel amount QFR from the fuel injection amount FQR derived at step 212 and the target air-fuel ratio AFREF at the current time. The target fuel amount QFR derived at step 213 is stored in the RAM 44 as "$QFR_1$". Finally, at step 214, the CPU 42 uses the foregoing equation (3) to derive the intake air amount GA. The intake air amount GA derived at step 214 is stored in the RAM 44 as "$GA_1$".

As described above, in the air-fuel ratio control system according to this embodiment, the A/F sensor 26 is arranged at the position so that the air-fuel ratio measured by the A/F sensor 26 reflects the 12-stroke prior combustion (and the exhaust gas generated thereby). Upon measurement of the air-fuel ratio by the A/F sensor 26, the 12-stroke prior fuel amount (in-cylinder fuel amount QFOLD) is estimated relative to the cylinder which discharged the measured gas (exhaust gas), using the result of the air-fuel ratio measurement by the A/F sensor 26 (step 203 in FIG. 8). Further, the deviation (in-cylinder fuel deviation DQFOLD) between the in-cylinder fuel amount QFOLD and the 12-stroke prior target fuel amount $QFR_{12}$ (RAM data) for the same cylinder at that time is derived (step 204 in FIG. 8), and the feedback correction value ΔFi is derived based on the in-cylinder fuel deviation DQFOLD (step 206 in FIG. 8). Then, the fuel injection amount is corrected using the feedback correction value ΔFi, and the fuel injection valve 7 is controlled based on the result of the correction (the routine of FIG. 7).

Thus, according to the foregoing arrangement, the cylinder causing the combustion which corresponds to the air-fuel ratio measured by the A/F sensor 26 can be identified, and the fuel injection amount correction is performed relative to the identified cylinder individually. This makes possible the air-fuel ratio control per cylinder so that unevenness in air-fuel ratios among the cylinders can be eliminated. Specifically, in a case of the multi-cylinder engine, unevenness in air-fuel ratios across the cylinders tends to occur due to difference among the individual fuel injection valves 7 and difference in suction efficiencies among the cylinders. This air-fuel ratio unevenness among the cylinders cannot be eliminated in the conventional techniques as proposed in, for example, the foregoing Japanese First Patent Publications Nos. 3-185244 and 4-209940. On the other hand, according to this embodiment, by matching the cylinder which discharged the exhaust gas measured by the A/F sensor 26 and the cylinder to be controlled upon such measurement by the A/F sensor 26, the result of the air-fuel ratio measurement can be reflected for the corresponding cylinder. Thus, the air-fuel ratio control corresponding to the individual cylinders can be easily achieved so that the air-fuel ratio unevenness among the cylinders can be eliminated.

Further, in this embodiment, the in-cylinder fuel deviations DQFOLD are accumulated per execution of the routine so as to derive the deviation integrated value SMQF (step 205 in FIG. 8), and the feedback correction value ΔFi is derived from the deviation integrated value SMQF (step 206 in FIG. 8). Accordingly, the reliability of the air-fuel ratio control is increased to further improve the control accuracy.

Further, in this embodiment, it is arranged that the exhaust gas from each cylinder is measured by the A/F sensor 26 after a lapse of 12 strokes from the corresponding fuel injection. Since the number of strokes "12" corresponds to a multiple of the number of all the cylinders, the measuring timing of the air-fuel ratio (sampling timing) and the calculation timing of the feedback correction value ΔFi (fuel injection amount calculation timing) can be matched with each other. As a result, reduction of the RAM data and simplification of the calculating process executed by the CPU 42 can be realized. Further, since the cylinder which discharged the measured exhaust gas always matches with the cylinder to be controlled upon such measurement, the determining process for determining the cylinder which discharged the measured exhaust gas can be omitted.

Now, a second preferred embodiment of the present invention will be described hereinbelow.

In the foregoing first preferred embodiment, it is assumed that the exhaust gases discharged from the respective cylinders are not mixed with each other, and the result of the measurement by the A/F sensor 26 is reflected on the fuel amount correction for the corresponding cylinder individually. On the other hand, in practice, it is considered that the exhaust gases from the different cylinders are mixed at a given rate and this mixed gas reaches the A/F sensor 26. Specifically, the measured exhaust gas at the A/F sensor 26 includes, in addition to the exhaust gas from a predetermined stroke prior cylinder (12-stroke prior cylinder in this embodiment), the exhaust gas from the cylinder immediately prior to the predetermined stroke prior cylinder. Thus, in this embodiment, when controlling the cylinder at the current time, weighting is performed relative to the exhaust gas from the cylinder to be controlled at the current time and the exhaust gas from the cylinder immediately prior thereto depending on a given mixing rate, and the feedback correction value ΔFi is derived depending on such weighting.

Specifically, the in-cylinder fuel deviation DQFOLD relative to the immediately prior cylinder is stored as RAM data "DQFX", and the deviation integrated value SMQF relative to the immediately prior cylinder is stored as RAM data "SMX". Using the foregoing RAM data "DQFX" and "SMX" and the in-cylinder fuel deviation DQFOLD and the deviation integrated value SMQF relative to the cylinder to be controlled at the current time, the feedback correction value ΔFi is derived. In this case, assuming that the mixing rate is 7:3, the feedback correction value ΔFi is derived from the following equation (8):

$$\Delta Fi[ms]=KGN\{\alpha(0.7\cdot SMQF+0.3\cdot SMX)+\beta(0.7\cdot DQFOLD+0.3\cdot DQFX)\} \quad (8)$$

Figure 9:
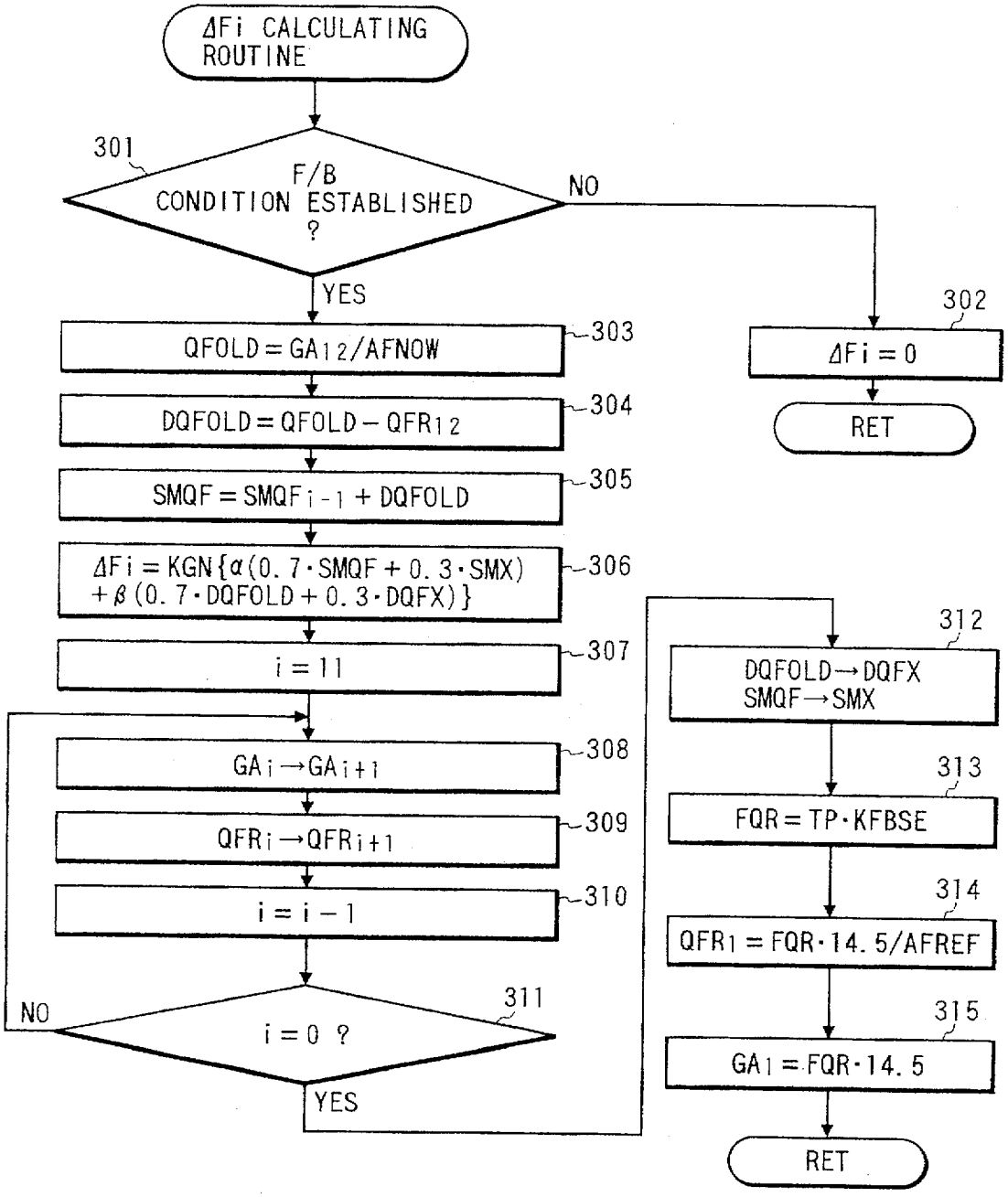
FIG. 9 is a flowchart showing a feedback correction value calculating routine according to a second preferred embodiment of the present invention.

FIG. 9 is a flowchart showing a ΔFi calculating routine according to the second preferred embodiment. As appreciated, steps 301 to 305 in FIG. 9 are identical with steps 201 to 205 in FIG. 8, steps 307 to 311 in FIG. 9 are identical with steps 207 to 211 in FIG. 8, and steps 313 to 315 in FIG. 9 are identical with steps 212 to 214 in FIG. 8. Specifically, FIG. 9 differs from FIG. 8 only in steps 306 and 312. Hereinbelow, only the difference will be explained.

In FIG. 9, at step 312, the current in-cylinder fuel deviation DQFOLD is stored in the RAM 44 as DQFX and the current deviation integrated value SMQF is stored in the RAM 44 as SMX. Further, at step 306, the CPU 42 uses the foregoing equation (8) to derive the feedback correction value ΔFi.

According to the second preferred embodiment, the predetermined weighting is performed relative to the correction terms (SMQF, DQFOLD) derived from the result of the measurement by the A/F sensor 26 for the cylinder to be controlled at the current time, and the correction terms (SMX, DQFX) derived from the result of the measurement by the A/F sensor 26 for the cylinder at least one-cylinder prior thereto. By performing such weighting, the further reliable air-fuel ratio control can be achieved.

Now, a third preferred embodiment of the present invention will be described hereinbelow.

In the foregoing second preferred embodiment, the given mixing rate of the exhaust gas from the cylinder to be controlled at the current time relative to the exhaust gas from the cylinder immediately prior thereto is set to 7:3, and the feedback correction value ΔFi is derived depending on the set mixing rate. However, in practice, it is considered that such a mixing rate changes depending on the engine operating condition. Accordingly, in this embodiment, the mixing rate is selectable depending on the engine operating condition.

Specifically, the feedback correction value ΔFi is derived from the following equation (9):

$$\Delta Fi[ms]=KGN\{\alpha(K1\cdot SMQF+K2\cdot SMX)+\beta(K1\cdot DQFOLD+$$

$K2 \cdot DQFX)\}$ (9)

wherein K1 and K2 are coefficients satisfying K1+K2=1, and K1:K2 represents a mixing rate of the exhaust gas from the cylinder to be controlled at the current time relative to the exhaust gas from the cylinder immediately prior thereto.

Figure 10:
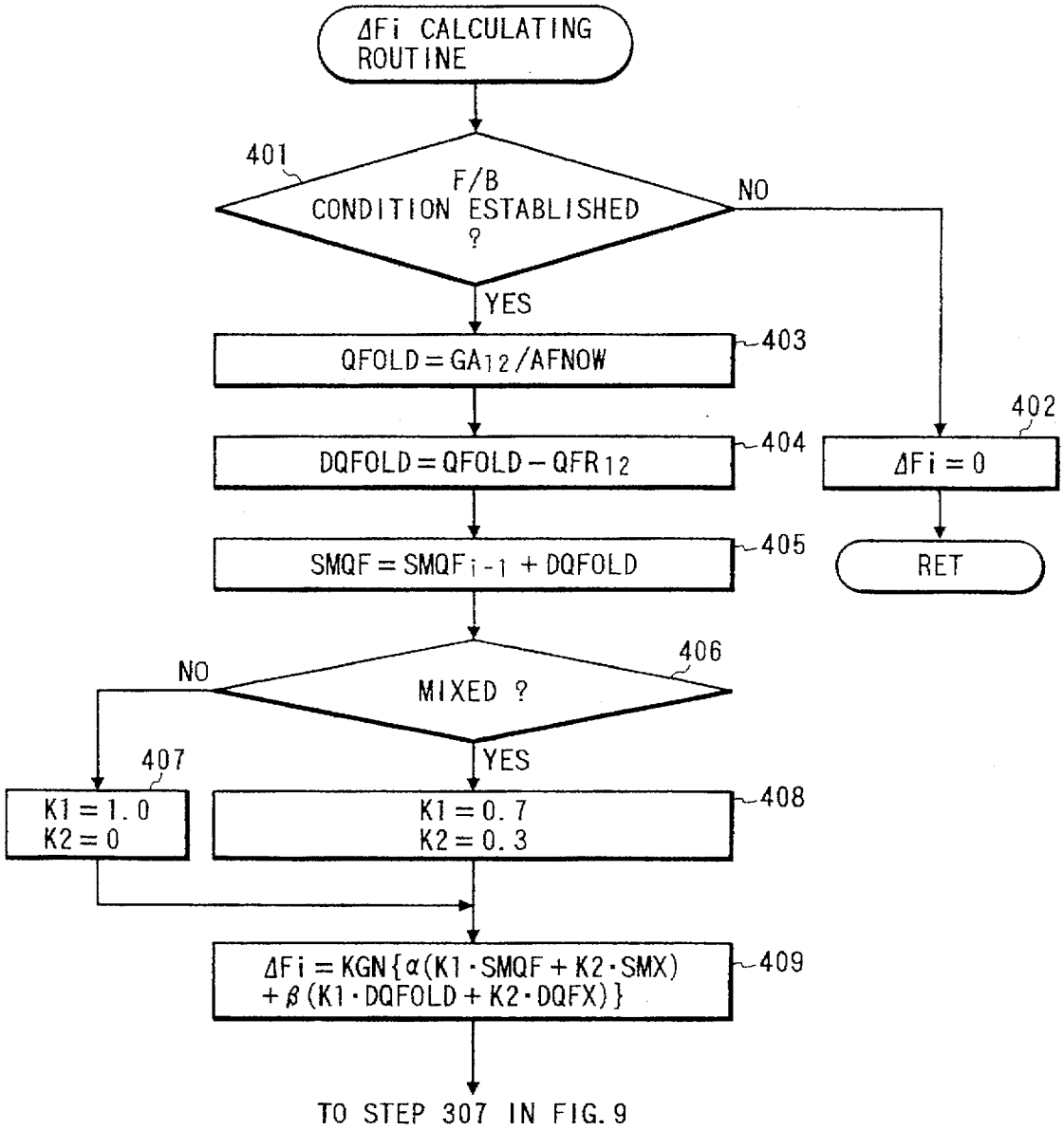
FIG. 10 is a flowchart showing a feedback correction value calculating routine according to a third preferred embodiment of the present invention.

FIG. 10 is a flowchart showing a portion of a ΔFi calculating routine according to the third preferred embodiment. Steps 401 to 409 shown in FIG. 10 replace steps 301 to 306 in FIG. 9, and thus the routine of FIG. 10 proceeds to step 307 in FIG. 9 from step 409. Through steps 401 to 405, the CPU 42 derives the in-cylinder fuel deviation DQFOLD and the deviation integrated value SMQF necessary for deriving the feedback correction value ΔFi. And before then, the RAM data "DQFX" and "SMX" for the immediately prior cylinder are stored in the RAM 44 (step 312 in FIG. 9).

Then, at step 406, the CPU 42 determines based on the monitored engine operating condition whether the exhaust gases are mixed or not. Specifically, if Ne≧3,000 rpm or PM≦100 mmHg, step 406 yields a positive answer. If negative at step 406, the routine proceeds to step 407 where K1=1.0 and K2=0. On the other hand, if positive at step 406, the routine proceeds to step 408 where K1=0.7 and K2=0.3. Thereafter, at step 409, the CPU 42 derives the feedback correction value ΔFi by substituting K1 and K2 set at step 407 or 408 into the foregoing equation (9).

Specifically, in this embodiment, when K1 and K2 at step 407 are used, the feedback correction value ΔFi becomes equal to that in the first preferred embodiment (no mixing of the exhaust gases), while, when K1 and K2 at step 408 are used, the feedback correction value ΔFi becomes equal to that in the second preferred embodiment. It is possible to change a rate of K1 and K2 and further possible to set the mixing rate to be selectable among three or more (for example, (1) K1=1.0, K2=0, (2) K1=0.85, K2=0.15, (3) K1=0.7, K2=0.3).

According to the third preferred embodiment, by changing the rate of weighting relative to the cylinders depending on the engine operating condition, the precise control of the air-fuel ratio following the actual engine operating condition can be achieved.

Now, a fourth preferred embodiment of the present invention will be described hereinbelow.

Figure 11:
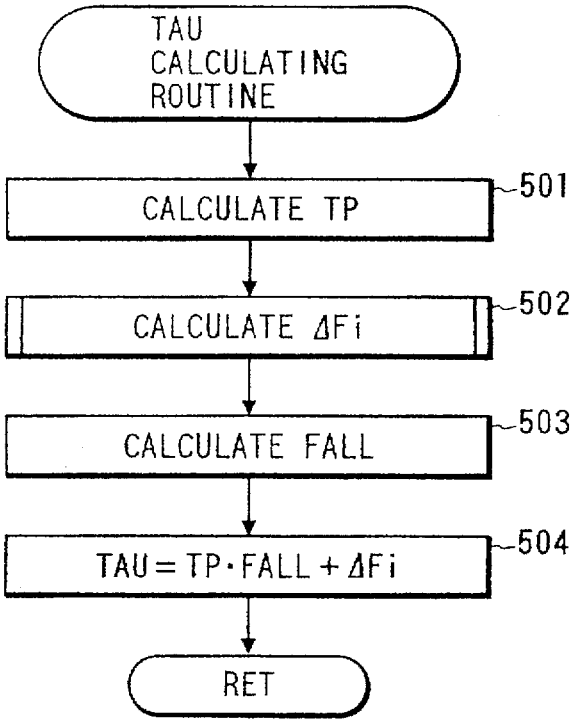
FIG. 11 is a flowchart showing a fuel injection amount calculating routine according to a fourth preferred embodiment of the present invention.
Figure 12:
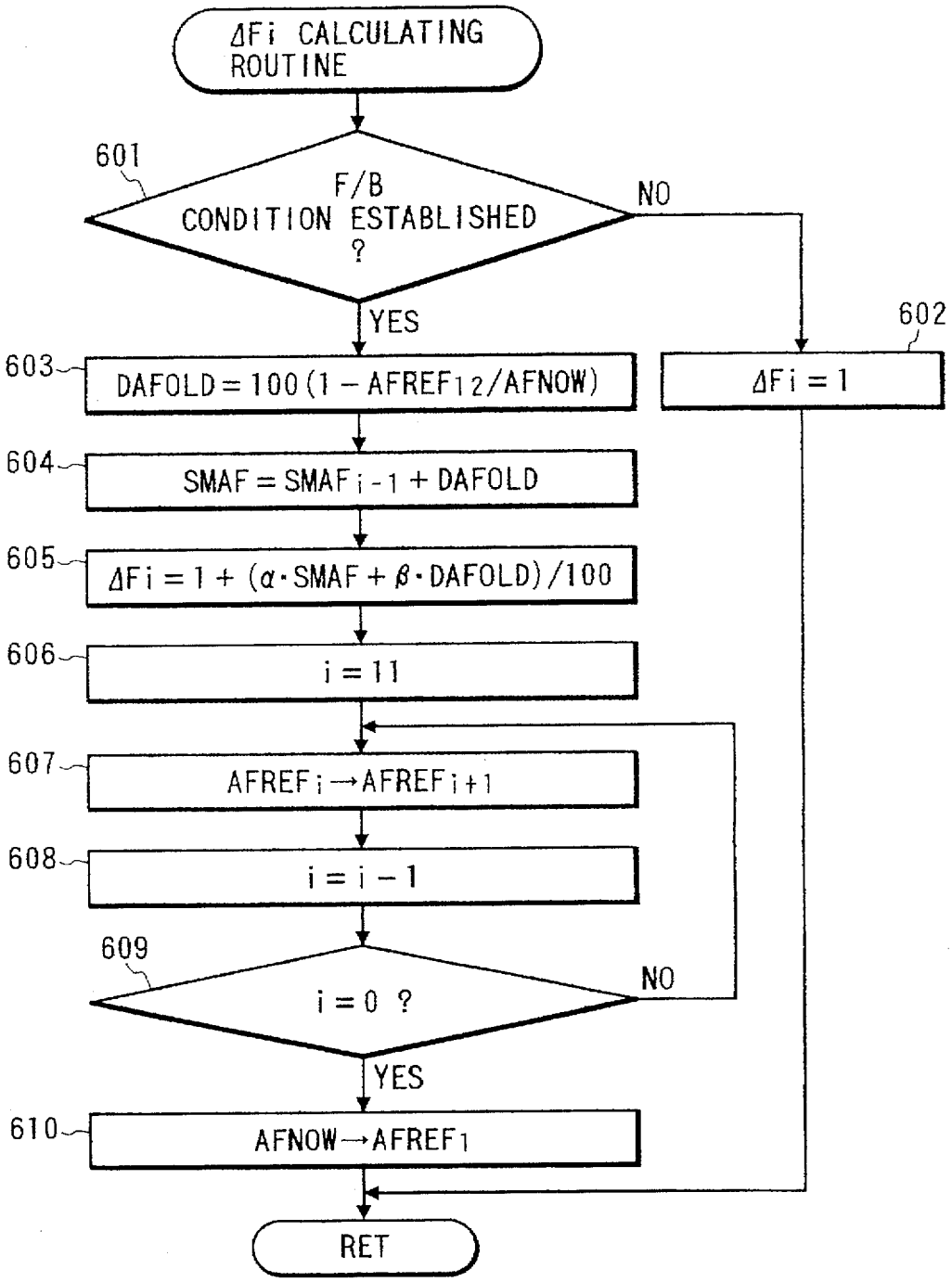
FIG. 12 is a flowchart showing a feedback correction value calculating routine according to the fourth preferred embodiment.

In each of the foregoing preferred embodiments, the feedback correction value ΔFi is derived based on the deviation between the in-cylinder fuel amount and the target fuel amount. On the other hand, in the fourth preferred embodiment, the feedback correction value ΔFi is derived based on a deviation between air-fuel ratios. A flowchart of FIG. 11 shows a fuel injection amount calculating routine according to the fourth preferred embodiment and corresponds to the flowchart of FIG. 7 according to the first preferred embodiment. A flowchart of FIG. 12 shows a ΔFi calculating routine according to the fourth preferred embodiment and corresponds to the flowchart of FIG. 8 according to the first preferred embodiment.

In FIG. 11, at first step 501, the CPU 42 derives a basic fuel injection time TP [ms] based on the monitored intake manifold pressure PM, engine speed Ne and the like. At subsequent step 502, the CPU 42 derives a feedback correction value ΔFi for achieving the air-fuel ratio feedback control. The feedback correction value ΔFi is a correction coefficient derived according to the routine shown in FIG. 12, which will be described later in detail.

Thereafter, at step 503, the CPU 42 derives a correction coefficient FALL from a water temperature based correction, an air conditioner based correction and others. Subsequently, at step 504, the CPU 42 derives a fuel injection time TAU [ms] as being the product of TP, FALL and ΔFi (TAU=TP·FALL·ΔFi).

In FIG. 7, the feedback correction value ΔFi is set to be a correction time (absolute value). On the other hand, in FIG. 11, the feedback correction value ΔFi is set to be a coefficient with a reference value being "1". Accordingly, at step 104 in FIG. 7, the feedback correction value ΔFi is added to the other term, while at step 504 in FIG. 11, the feedback correction value ΔFi is used as a multiplier to the other term.

Before describing the routine of FIG. 12, various calculation parameters to be used in the routine will be first explained. In the fourth preferred embodiment, based on a rate between RAM data "$AFREF_{12}$" representing a 12-stroke prior target air-fuel ratio AFREF and an air-fuel ratio AFNOW at the current time, a deviation in air-fuel ratio (hereinafter referred to as "air-fuel ratio deviation DAFOLD") is derived from the following equation (10):

$$DAFOLD[\%]=100\cdot(1-AFREF_{12}/AFNOW) \quad (10)$$

Further, an integrated value (hereinafter referred to as "deviation integrated value SMAF") of the air-fuel ratio deviation DAFOLD derived by the equation (10) is derived from the following equation (11):

$$SMAF[\%]=SMAF_{i-1}+DAFOLD \quad (11)$$

Then, using DAFOLD derived from the equation (10) and SMAF derived from the equation (11), the feedback correction value ΔFi is derived from the following equation (12):

$$\Delta Fi=1+(\alpha\cdot SMAF+\beta\cdot DAFOLD)/100 \quad (12)$$

wherein α is an integral term reflecting coefficient, and β is a proportional term reflecting coefficient.

Now, the ΔFi calculating routine of FIG. 12, which is prepared using the foregoing fundamental logic, will be described hereinbelow.

In FIG. 12, at first step 601, the CPU 42 determines whether the feedback condition for the air-fuel ratio control is established. If the feedback condition is not established, the routine proceeds to step 602 where the feedback correction value ΔFi is set to "1", and then is terminated.

On the other hand, if the feedback condition is established at step 601, the routine proceeds to step 603 where the CPU 42 uses the foregoing equation (10) to derive the air-fuel ratio deviation DAFOLD from the 12-stroke prior target air-fuel ratio $AFREF_{12}$ and the air-fuel ratio AFNOW (the result of the measurement by the A/F sensor 26 at the current time).

Subsequently, at step 604, the CPU 42 uses the foregoing equation (11) to derive the current deviation integrated value SMAF from the last deviation integrated value $SMAF_{i-1}$ and the air-fuel ratio deviation DAFOLD derived at step 603. Then, at step 605, the CPU 42 uses the foregoing equation (12) to derive the feedback correction value ΔFi from the deviation integrated value SMAF derived at step 604 and the air-fuel ratio deviation DAFOLD derived at step 603.

Thereafter, through steps 606 to 609, the CPU 42 performs a storing process for the RAM data for the next execution of this ΔFi calculating routine. Specifically, at step 606, "i" is set to "11" (i=11). Subsequently, at step 607, the RAM data "$AFREF_i$" is set to "$AFREF_{i+1}$" ($AFREF_i \rightarrow AFREF_{i+1}$). Then, at step 608, "i" is decremented by "1" (i=i−1), and at step 609, it is checked whether i=0. If i≠0, the routine returns to step 607 and the CPU 42 executes steps 607 to 609. Specifically, until i=0 is established at step 609, steps 607 to 609 are repeatedly executed. Through the execution of these steps, the RAM data "$AFREF_1$ to $AFREF_{11}$" are stored as "$AFREF_2$ to $AFREF_{12}$".

If the answer at step 609 becomes positive, the routine proceeds to step 610 where the current air-fuel ratio AFNOW (measured value by the A/F sensor 26) is stored as "$AFREF_1$" in the RAM 44, and then is terminated.

As described above, in the fourth preferred embodiment, upon measurement of the air-fuel ratio by the A/F sensor 26, the deviation (the air-fuel ratio deviation DAFOLD) between the result of the air-fuel ratio measurement (the current air-fuel ratio AFNOW) and the 12-stroke prior target air-fuel ratio $AFREF_{12}$ for the same cylinder is derived (step 603 in FIG. 12), and the feedback correction value ΔFi is derived based on the air-fuel ratio deviation DAFOLD (step 605 in FIG. 12). Then, the fuel injection amount is corrected using the feedback correction value ΔFi, and the fuel injection valve 7 is controlled based on the result of the correction (the routine of FIG. 11).

Since, upon measurement of the air-fuel ratio by the A/F sensor 26, the cylinder which discharged the measured exhaust gas and the cylinder to be controlled upon such measurement are the same, the air-fuel ratio control per cylinder can be achieved to eliminate unevenness in air-fuel ratios among the cylinders by performing the air-fuel ratio control depending on the deviation between the air-fuel ratio AFNOW obtained upon such measurement and the 12-stroke prior target air-fuel ratio $AFREF_{12}$.

While the present invention has been described in terms of the preferred embodiments, the invention is not to be limited thereto, but can be embodied in various ways without departing from the principle of the invention as defined in the appended claims, for example, as follows:

(1) In the foregoing preferred embodiments, the present invention is applied to the in-line four-cylinder engine. On the other hand, the present invention is also applicable to other multi-cylinder internal combustion engines. FIG. 13A shows an in-line six-cylinder engine, wherein an A/F sensor 26 is disposed at a collecting portion of an exhaust manifold 11. FIG. 13B shows a V-type or horizontal-opposed six-cylinder engine, wherein A/F sensors 26A and 26B are disposed at collecting portions of exhaust manifolds 11A and 11B, respectively. FIG. 13C shows a V-type or horizontal-opposed eight-cylinder engine, wherein A/F sensors 26A and 26B are disposed at collecting portions of exhaust manifolds 11A and 11B, respectively.

It is preferable that the exhaust gas discharged from each cylinder is measured by the A/F sensor after the number of strokes as shown in FIG. 14. Specifically, it is preferable in the in-line multi-cylinder engine that the exhaust gas is measured after the number of strokes corresponding to a multiple of the number of all the cylinders. On the other hand, it is preferable in the V-type or horizontal-opposed multi-cylinder engine that the exhaust gas is measured after the number of strokes corresponding to a multiple of the number of cylinders on one bank. With this arrangement, reduction of the RAM data and simplification of the calculation process executed by the CPU 42 can be achieved.

Figure 15:
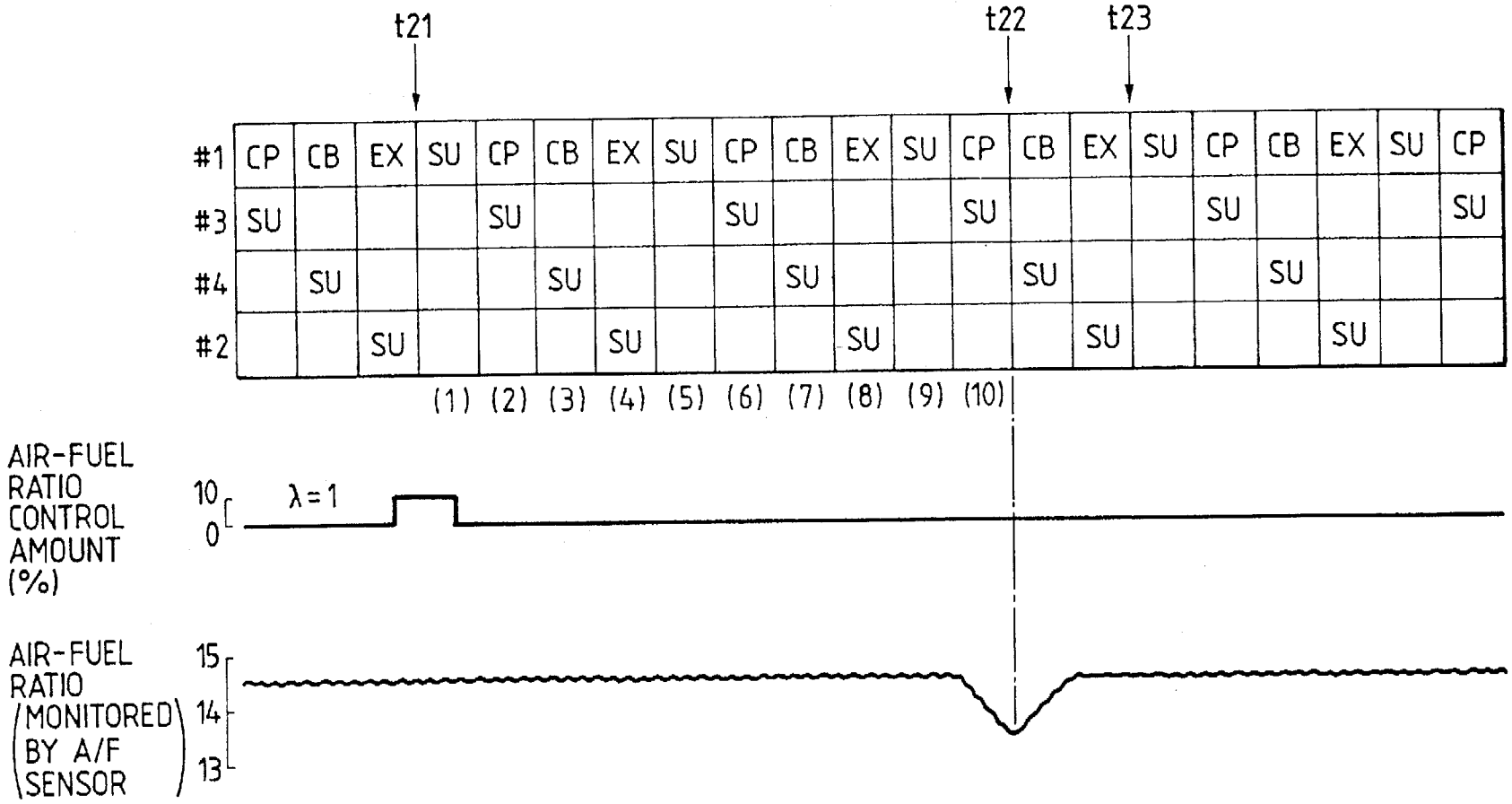
FIG. 15 is a time chart for explaining another preferred embodiment.

(2) In the foregoing preferred embodiments, after the number of strokes, corresponding to a multiple of the number of cylinders, from the fuel injection, the A/F sensor measures the air-fuel ratio corresponding to that fuel injection. Although this arrangement is preferable for simplification of the calculation process as described above, the present invention is also applicable to a case where the air-fuel ratio measuring timing and the feedback correction value calculation timing do not match with each other. For example, in FIG. 15, at time t21, the fuel injection amount is calculated so as to increase (enrich) the fuel relative to the cylinder #1, and the fuel injection is performed for the cylinder #1 immediately after t21. Then, at time t22 after a lapse of 10 strokes from the suction stroke where the fuel injection is performed, the air-fuel ratio enrichment due to the fuel increment is measured by the A/F sensor 26. Although time t22 represents the calculation timing for the cylinder #4, the measured air-fuel ratio at time t22 is not used for the air-fuel ratio correction relative to the cylinder #4. Then, at time t23 (2-stroke after time t22) where the cylinder #1 is to be controlled, the air-fuel ratio measured at time t22 is used for the air-fuel ratio correction. Specifically, the air-fuel ratio correction value (the feedback correction value ΔFi) is derived using the result of the measurement after 10 strokes from the foregoing fuel increment. Even with this arrangement, the air-fuel ratio measured by the A/F sensor 26 can be reflected for the corresponding cylinder to be controlled so that unevenness in air-fuel ratios among the cylinders can be eliminated.

Further, according to the foregoing arrangement, the present invention is also applicable to the existent engine where the disposing position of the A/F sensor is not particularly defined. Specifically, if it is known as to at which timing the response of the A/F sensor is obtained, the present invention can be realized without changing the hardware structure (the sensor disposing position or the like).

(3) In the foregoing second and third preferred embodiments, the air-fuel ratio correcting procedure (ΔFi calculating procedure) has been explained assuming that the exhaust gases from two cylinders are mixed with each other. On the other hand, assuming that the exhaust gases from three cylinders are mixed with each other, the foregoing equation (9) may be modified as follows:

$$\Delta Fi = KGN\ \{\alpha(K1 \cdot SMQF + K2 \cdot SMX + K3 \cdot SMXX) + \beta(K1 \cdot DQFOLD + K2 \cdot DQFX + K3 \cdot DQFXX)\}$$

In the above equation, K1 represents a rate of the exhaust gas from a cylinder to be controlled at that time, K2 represents a rate of the exhaust gas from a one-cylinder prior cylinder, and K3 represents a rate of the exhaust gas from a two-cylinder prior cylinder, wherein K1+K2+K3=1. Further, "SMXX" represents a deviation integrated value relative to a two-injection prior fuel injection, and "DQFXX" represents an in-cylinder fuel deviation relative to the two-injection prior fuel injection. It may be arranged, for example, that fixed values are set like K1=0.7, K2=0.2 and K3=0.1, or that K1 to K3 are variably set depending on the engine operating conditions.

(4) In the foregoing preferred embodiments, the integrating process for the in-cylinder deviation DQFOLD (step 205 in FIG. 8) or the air-fuel ratio deviation DAFOLD (step 604 in FIG. 12) is performed without discrimination among the cylinders. On the other hand, it may be performed per cylinder individually. Specifically, the foregoing integrating process is performed per cylinder using a cylinder discriminating device. In this case, the deviation integrated value SMQF, SMAF is stored as the RAM data for each cylinder.

(5) In the foregoing preferred embodiments, the present invention is applied to the multi-cylinder engine of an MPI type. On the other hand, the present invention is also applicable to the multi-cylinder engine of an SPI (single point injection) type.

What is claimed is:

1. An air-fuel ratio control system for a multi-cylinder internal combustion engine, comprising:

an air-fuel ratio sensor arranged at a collecting portion of an exhaust manifold for monitoring an exhaust gas so as to detect an air-fuel ratio in a linear fashion; and air-fuel ratio control means for controlling said air-fuel ratio detected by said air-fuel ratio sensor so as to converge said air-fuel ratio to a target air-fuel ratio, wherein said air-fuel ratio sensor is arranged at a position so as to detect said air-fuel ratio for one of a plurality of cylinders, said air-fuel ratio corresponding to a prior fuel injection for said one of said plurality of cylinders having occurred a predetermined number of fuel injections earlier, and wherein said air-fuel ratio is detected for said one of said plurality of cylinders while said air-fuel ratio control means controls said air-fuel ratio for said one of said plurality of cylinders based on said air-fuel ratio which is concurrently detected.

2. The air-fuel ratio control system according to claim 1, wherein said air-fuel ratio control means further controls said air-fuel ratio for said one of said plurality of cylinders based on a prior target air-fuel ratio for said one of said plurality of cylinders, said prior target air-fuel ratio having been determined said predetermined number of prior target air-fuel ratio determinations earlier.

3. The air-fuel ratio control system according to claim 1, wherein:

said air-fuel ratio control means comprises:

first estimating means for estimating a fuel amount supplied to said engine based on said target air-fuel ratio and storing said estimated fuel amount for each cylinder of said plurality of cylinders, and second estimating means for estimating a fuel amount supplied to said engine based on said air-fuel ratio detected by said air-fuel ratio sensor, and said air-fuel ratio control means controls said air-fuel ratio for said one of said plurality of cylinders based on said fuel amount estimated by said second estimating means and a prior value of said fuel amount estimated said predetermined number of times earlier by said first estimating means.

4. The air-fuel ratio control system according to claim 1, wherein said air-fuel ratio control means further controls said air-fuel ratio for said one of said plurality of cylinders based on another air-fuel ratio detected by said air-fuel ratio sensor while controlling said another air-fuel ratio for another one of said plurality of cylinders being one-cylinder prior to said one of said plurality of cylinders.

5. The air-fuel ratio control system according to claim 4, wherein:

said air-fuel ratio control means changes a rate of reflecting said air-fuel ratio detected by said air-fuel ratio sensor while controlling said air-fuel ratio for said one of said plurality of cylinders, and said another air-fuel ratio detected by said air-fuel ratio sensor while controlling said another air-fuel ratio for said another one of said plurality of cylinders, and an operation of said air-fuel ratio control means depends on an operating condition of said engine.

6. An air-fuel ratio control system for a multi-cylinder internal combustion engine, comprising:

an air-fuel ratio sensor arranged at a collecting portion of an exhaust manifold for monitoring an exhaust gas so as to detect an air-fuel ratio in a linear fashion;

basic fuel amount deriving means for deriving a basic fuel amount supplied to said engine; and air-fuel ratio control means for deriving an air-fuel ratio correction value for correcting a fuel amount so as to control said air-fuel ratio detected by said air-fuel ratio sensor to converge said air-fuel ratio to a target air-fuel ratio and for correcting said basic fuel amount based on said air-fuel ratio correction value, wherein said air-fuel ratio sensor is arranged at a position so as to detect, while said air-fuel ratio control means calculates said air-fuel ratio correction value for one of a plurality of cylinders, said air-fuel ratio corresponding to a prior fuel injection having occurred a predetermined number of fuel injections earlier, said prior fuel injection having occurred for said one of said plurality of cylinders, and wherein said air-fuel ratio control means derives said air-fuel ratio correction value for said one of said plurality of cylinders based on said air-fuel ratio detected by said air-fuel ratio sensor while said air-fuel ratio control means calculates said air-fuel ratio correction value.

7. The air-fuel ratio control system according to claim 6, wherein said air-fuel ratio control means derives said air-fuel ratio correction value for said one of said plurality of cylinders further based on a prior target air fuel ratio for said one of said plurality of cylinders, said prior target air-fuel ratio having occurred said predetermined number of target air-fuel ratio determinations earlier.

8. The air-fuel ratio control system according to claim 6, wherein:

said air-fuel ratio control means comprises:

first estimating means for estimating a fuel amount supplied to said engine based on said target air-fuel ratio and storing said estimated fuel amount for each cylinder of said plurality of cylinders, and second estimating means for estimating a fuel amount supplied to said engine based on said air-fuel ratio detected by said air-fuel ratio sensor, and wherein said air-fuel ratio control means derives said air-fuel ratio correction value for said one of said plurality of cylinders based on said fuel amount estimated by said second estimating means and a prior fuel amount, said prior fuel amount having been estimated by said first estimating means said predetermined number of fuel amount estimations earlier.

9. The air-fuel ratio control system according to claim 6, wherein said air-fuel ratio control means derives said air-fuel ratio correction value for said one of said plurality of cylinders further based on an air-fuel ratio correction value for another one of said plurality of cylinders being one-cylinder prior to said one of said plurality of cylinders.

10. The air-fuel ratio control system according to claim 9, wherein:

said air-fuel ratio control means changes a rate of reflecting said air-fuel ratio correction value based on said air-fuel ratio detected by said air-fuel ratio sensor while said air-fuel ratio control means calculates said air-fuel ratio correction value for said one of said plurality of cylinders, and based on an air-fuel ratio correction value for said another one of said plurality of cylinders, and a calculation of said air-fuel ratio correction value for said one of said plurality of cylinders depends on an operating condition of said engine.

11. An air-fuel ratio control system for a multi-cylinder internal combustion engine, comprising:

an air-fuel ratio sensor arranged at a collecting portion of an exhaust manifold for monitoring an exhaust gas so as to detect an air-fuel ratio in a linear fashion; and an electronic control unit for controlling said air-fuel ratio detected by said air-fuel ratio sensor so as to converge said air-fuel ratio to a target air-fuel ratio, said electronic control unit comprising:

a CPU;

a ROM;

a RAM;

an input port receiving a signal from said air-fuel ratio sensor, said signal representing said air-fuel ratio; and an output port sending signals to a plurality of fuel injectors to control an amount of fuel injected; and a bus connecting said CPU, said ROM, said RAM, said input port and said output port, wherein said air-fuel ratio sensor is arranged at a position so as to detect said air-fuel ratio for one of a plurality of cylinders, said air-fuel ratio corresponding to a prior fuel injection for said one of said plurality of cylinders having occurred a predetermined number of fuel injections earlier, and wherein said air-fuel ratio is detected while said electronic control unit controls said air-fuel ratio for said one of said plurality of cylinders based on said air-fuel ratio which is concurrently detected.

12. The air-fuel ratio control system according to claim 11, wherein said electronic control unit further controls said air-fuel ratio for said one of said plurality of cylinders based on a prior target air-fuel ratio for said one of said plurality of cylinders, said prior target air-fuel ratio having been determined said predetermined number of prior target air-fuel ratio determinations earlier.

13. The air-fuel ratio control system according to claim 11, wherein:

said electronic control unit estimates a first fuel amount supplied to said engine based on said target air-fuel ratio and stores said first fuel amount for each cylinder of said plurality of cylinders, and said electronic control unit estimates a second fuel amount supplied to said engine based on said air-fuel ratio detected by said air-fuel ratio sensor, and said electronic control unit controls said air-fuel ratio for said one of said plurality of cylinders based on said second fuel amount and a prior value of said first fuel amount, said prior value of said first fuel amount having been estimated said predetermined number of times earlier by said electronic control unit.

14. The air-fuel ratio control system according to claim 11, wherein said electronic control unit further controls said air-fuel ratio for said one of said plurality of cylinders based on another air-fuel ratio detected by said air-fuel ratio sensor while controlling said another air-fuel ratio for another one of said plurality of cylinders being one-cylinder prior to said one of said plurality of cylinders.

15. The air-fuel ratio control system according to claim 14, wherein said electronic control unit changes a rate of reflecting said air-fuel ratio detected by said air-fuel ratio sensor while controlling said air-fuel ratio for said one of said plurality of cylinders, and said another air-fuel ratio detected by said air-fuel ratio sensor while controlling said another air-fuel ratio for said another one of said plurality of cylinders, and an operation of said electronic control unit depends on an operating condition of said engine.

16. An air-fuel ratio control system for a multi-cylinder internal combustion engine, comprising:

an air-fuel ratio sensor arranged at a collecting portion of an exhaust manifold for monitoring an exhaust gas so as to detect an air-fuel ratio in a linear fashion;

an electronic control unit comprising:

a CPU;

a ROM;

a RAM;

an input port receiving input from said air-fuel ratio sensor;

an output port sending signals to a plurality of fuel injectors to control an amount of fuel injected; and a bus connecting said CPU, said ROM, said RAM, said input port and said output port, wherein said electronic control unit derives a basic fuel amount supplied to said engine, and said electronic control unit derives an air-fuel ratio correction value for correcting a fuel amount so as to control said air-fuel ratio detected by said air-fuel ratio sensor to converge said air-fuel ratio to a target air-fuel ratio and corrects said basic fuel amount based on said air-fuel ratio correction value, said air-fuel ratio sensor is arranged at a position so as to detect, while said electronic control unit calculates said air-fuel ratio correction value for one of a plurality of cylinders, said air-fuel ratio corresponding to a prior fuel injection having occurred a predetermined number of fuel injections earlier, said prior fuel injection having occurred for said one of said plurality of cylinders, and said electronic control unit derives said air-fuel ratio correction value for said one of said plurality of cylinders based on said air-fuel ratio detected by said air-fuel ratio sensor while said electronic control unit calculates said air-fuel ratio correction value.

17. The air-fuel ratio control system according to claim 16, wherein said electronic control unit derives said air-fuel ratio correction value for said one of said plurality of cylinders further based on a prior target air fuel ratio for said one of said plurality of cylinders, said prior target air-fuel ratio having occurred said predetermined number of target air-fuel ratio determinations earlier.

18. The air-fuel ratio control system according to claim 16, wherein:

said electronic control unit estimates a first fuel amount supplied to said engine based on said target air-fuel ratio and stores said first fuel amount for each cylinder of said plurality of cylinders, and said electronic control unit estimates a second fuel amount supplied to said engine based on said air-fuel ratio detected by said air-fuel ratio sensor, and said electronic control unit derives said air-fuel ratio correction value for said one of said plurality of cylinders based on said second fuel amount and a prior first fuel amount, said prior first fuel amount having been estimated by said electronic control unit said predetermined number of first fuel amount estimations earlier.

19. The air-fuel ratio control system according to claim 16, wherein said electronic control unit derives said air-fuel ratio correction value for said one of said plurality of cylinders further based on an air-fuel ratio correction value for another one of said plurality of cylinders being one-cylinder prior to said one of said plurality of cylinders.

20. The air-fuel ratio control system according to claim 19, wherein:

said electronic control unit changes a rate of reflecting said air-fuel ratio correction value based on said air-fuel ratio detected by said air-fuel ratio sensor while said electronic control unit calculates said air-fuel ratio correction value for said one of said plurality of cylinders, and based on an air-fuel ratio correction value for said another one of said plurality of cylinders, and a calculation of said air-fuel ratio correction value for said one of said plurality of cylinders depends on an operating condition of said engine.

* * * * *